US010945079B2

(12) United States Patent
Skoglund et al.

(10) Patent No.: US 10,945,079 B2
(45) Date of Patent: Mar. 9, 2021

(54) HEARING SYSTEM CONFIGURED TO LOCALIZE A TARGET SOUND SOURCE

(71) Applicant: Oticon A/S, Smørum (DK)

(72) Inventors: Martin Skoglund, Smørum (DK); Thomas Lunner, Smørum (DK); Fredrik Gustafsson, Linköping (SE)

(73) Assignee: OTICON A/S, Smørum (DK)

( * ) Notice: Subject to any disclaimer, the term of this patent is extended or adjusted under 35 U.S.C. 154(b) by 253 days.

(21) Appl. No.: 16/171,976

(22) Filed: Oct. 26, 2018

(65) Prior Publication Data

US 2019/0132685 A1 May 2, 2019

(30) Foreign Application Priority Data

Oct. 27, 2017 (EP) ..... 17199061

(51) Int. Cl.
*H04R 25/00* (2006.01)
*H04R 1/40* (2006.01)
(Continued)

(52) U.S. Cl.
CPC ..... *H04R 25/405* (2013.01); *G10K 11/341* (2013.01); *G10L 21/02* (2013.01);
(Continued)

(58) Field of Classification Search
CPC .... H04R 1/406; H04R 25/405; H04R 25/407; H04R 25/552; H04R 25/554;
(Continued)

(56) References Cited

U.S. PATENT DOCUMENTS 9,860,656 B2 * 1/2018 Jensen ..... H04R 25/505
2008/0199025 A1 8/2008 Amada
(Continued)

FOREIGN PATENT DOCUMENTS

EP 2 701 145 A1 2/2014
EP 3 185 590 A1 6/2017
(Continued)

*Primary Examiner* — Huyen D Le
(74) *Attorney, Agent, or Firm* — Birch, Stewart, Kolasch & Birch, LLP

(57) ABSTRACT

A hearing system is adapted to be worn by a user and configured to capture sound in an environment of the user and comprises a) a sensor array comprising M transducers for providing M electric input signals representing said sound and having a known geometrical configuration relative to each other; b) a detector unit for detecting movements over time of the hearing system, and providing location data of said sensor array at different points in time t, t=1, . . . , N; c) a first processor for receiving said electric input signals and—in case said sound comprises sound from a localized sound source S—for extracting sensor array configuration specific data $\tau_{ij}$ of said sensor array indicative of differences between a time of arrival of sound from said localized sound source S at said respective input transducers, at said different points in time t, t=1, . . . , N; and d) a second processor configured to estimate data indicative of a location of said localized sound source S relative to the user based on corresponding values of said location data and said sensor array configuration data at said different points in time t, t=1, . . . , N.

20 Claims, 8 Drawing Sheets

(51) Int. Cl.

| | |
|---|---|
| ***G10K 11/34*** | (2006.01) |
| ***H04R 3/00*** | (2006.01) |
| ***G10L 21/02*** | (2013.01) |
| ***H04R 29/00*** | (2006.01) |
| *H04R 1/10* | (2006.01) |

(52) U.S. Cl.
CPC ..... *H04R 1/406* (2013.01); *H04R 3/005* (2013.01); *H04R 25/407* (2013.01); *H04R 25/552* (2013.01); *H04R 29/004* (2013.01); *H04R 1/1091* (2013.01); *H04R 2201/403* (2013.01); *H04R 2430/20* (2013.01)

(58) Field of Classification Search
CPC ..... H04R 25/606; H04R 2225/41; H04R 2225/43; H04R 2430/20
USPC ..... 381/312, 313, 315, 317, 71.1
See application file for complete search history.

(56) References Cited

U.S. PATENT DOCUMENTS

| | | | | |
|---|---|---|---|---|
| 2010/0128892 | A1 | 5/2010 | Chen et al. | |
| 2012/0215519 | A1 | 8/2012 | Park et al. | |
| 2013/0332156 | A1 | 12/2013 | Tackin et al. | |
| 2014/0023199 | A1* | 1/2014 | Giesbrecht ..... | G10L 21/0216 381/71.1 |
| 2015/0230026 | A1 | 8/2015 | Eichfeld et al. | |
| 2016/0249132 | A1 | 8/2016 | Oliaei | |
| 2017/0295437 | A1* | 10/2017 | Bertelsen ..... | H04R 25/405 |

FOREIGN PATENT DOCUMENTS

| | | | |
|---|---|---|---|
| EP | 3 267 697 | A1 | 1/2018 |
| GB | 2495131 | A | 4/2013 |
| WO | WO 2011/063857 | A1 | 6/2011 |

* cited by examiner

HEARING SYSTEM CONFIGURED TO LOCALIZE A TARGET SOUND SOURCE

SUMMARY

The present application relates to hearing devices, e.g. hearing aids, and in particular to the capture of sound signals in an environment around a user. An embodiment of the disclosure relates to Synthetic Aperture Direction of Arrival, e.g. using hearing aids and possibly Inertial Sensors. An embodiment of the disclosure relates to body worn (e.g. head worn) hearing devices comprising a carrier with a dimension larger than a typical hearing aid adapted to be located in or at an ear of a user, e.g. larger than 0.05 m, e.g. embodied in a spectacle frame.

Direction of Arrival (DOA) is a technique to estimate the direction to a source of interest. In this context, the sources of interest are primarily human speakers but the technique applies to any sound source. In many scenarios it is of interest to be able to separate sound sources by means of their spatial distribution, i.e., their different DOAs. Examples are source classification in "cocktail party" scenarios, beamforming for noise attenuation, and the much related "restaurant problem solver". Two fundamental restrictions come into play when DOA is done using a hearing system comprising only left and right hearing devices, e.g. hearing aids (HAs), located at left and right ears of a user, the left and right hearing devices each comprising at least one input transducer, e.g. a microphone, the input transducers together defining a transducer (e.g. microphone) array (termed the DOA array):

1. With the right and the left HA, only considering one microphone per HA, constituting the DOA array, only an angle between a line from an origin of the DOA array to a sound source (a vector) and an array vector can be calculated, both being vectors in 3D space (cf. FIG. 1B). This means that the DOA is ambiguous in 3D space, i.e., the elevation and azimuth to a sound source cannot be determined separately. In the 2D case, i.e., when the array and the source is in the same plane, there is only a mirroring ambiguity at which it cannot be determined if a sound source is in front or behind the array.
2. If the HA user moves, by turning his or her head (pure rotation), and/or is otherwise moving (translation), it cannot be determined whether it is the HA user or the sound source that moves.

To address these restrictions, HAs equipped with 3D gyroscopes, 3D accelerometers and 3D magnetometers, so-called Inertial Measurements Units, IMUs for short, are considered. The IMUs allow for estimation of the HA orientation, and correspondingly the DOA array orientation, with respect to the local gravity field and the local magnetic field. Also, in short time intervals, the translation of the HA can be estimated. With the orientation and translation of the DOA array as estimated with the IMUs, the restrictions listed above can be circumvented.

A Hearing System:

The present disclosure aims at estimating a three dimensional (3D) direction to sound sources in an environment around a user, given two, or more, DOA measurements using (spatially) distinct DOA array orientations (where a rotation is not performed around the sensor array, as this is non-informative). The present disclosure also allows for estimation of the 3D location of a sound source given three, or more, distinct DOA array positions (where the sensor array positions must not be laying directly on the DOA, as this is non-informative).

In summary, by estimating (or recording) the HA user's head position and orientation over time (reflecting a movement of the user relative to the sound source), a 3D DOA sensor from a 2D DOA sensor array can be synthesized. This allows 3D DOA to sound sources and 3D position of sound sources to be estimated.

In an aspect of the present application, a hearing system adapted to be worn by a user and configured to capture sound in an environment of the user (when said hearing system is operationally mounted on the user) is provided. The hearing system comprises A sensor array of M input transducers, e.g. microphones, where M≥2, each for providing an electric input signal representing said sound in said environment, said input transducers $p_i$, i=1, . . . , M, of said array having a known geometrical configuration relative to each other, when worn by the user.

The hearing system further comprises,

A detector unit for detecting movements over time of the hearing system when worn by the user, and providing location data of said sensor array at different points in time t, t=1, . . . , N;

A first processor for receiving said electric input signals and (in case said sound comprises sound from a localized sound source S) for extracting sensor array configuration specific data $\tau_{ij}$ of said sensor array indicative of differences between a time of arrival of sound from said localized sound source S at said respective input transducers, at said different points in time t, t=1, . . . , N; and A second processor configured to estimate data indicative of a location of said localized sound source S relative to the user based on corresponding values of said location data and said sensor array configuration data at said different points in time t, t=1, . . . , N.

Thereby an improved hearing system may be provided.

The term 'a localized sound source', e.g. a sound source comprising speech from a human being, is e.g. taken to mean a point-like sound source having specific (non-diffuse) origin in space in the environment of the user. The localized sound source may be mobile relative to the user (either due to the movement of the user or the localized sound source S, or both).

In an embodiment, an initial spatial location of the user, including the hearing system (including the sensor array), (e.g. at t=0) is known to the hearing system, e.g. in an inertial coordinate system. In an embodiment, an initial spatial location of the sound source (e.g. at t=0) is known to the hearing system. In an embodiment, an initial spatial location of the user, including the hearing system (including the sensor array) as well as an initial spatial location of the sound source (e.g. at t=0) is known to the hearing system. The inertial coordinate system may be fixed to a specific room. The location of the input transducers of the sensor array may be defined in a body coordinate system fixed in relation to the user's body.

The detector unit may be configured to detect rotational and/or translational movements of the hearing system. The detector unit may comprise individual sensors, or integrated sensors.

The data indicative of a location of said localized sound source S relative to the user at said different points in time t, t=1, . . . , N, may constitute or comprise a direction of arrival of sound from said sound source S.

T data indicative of a location of said localized sound source S relative to the user at said different points in time t, t=1, . . . , N, may comprise a coordinates of said sound source relative said user, or direction of arrival of sound from and distance to said sound source relative said user.

The detector unit may comprise a number of IMU-sensors including at least one of an accelerometer, a gyroscope and a magnetometer. Inertial measurement units (IMUs), e.g. accelerometers, gyroscopes, and magnetometers, and combinations thereof, are available in a multitude of forms (e.g. multi-axis, such as 3D-versions), e.g. constituted by or forming part of an integrated circuit, and thus suitable for integration, even in miniature devices, such as hearing devices, e.g. hearing aids. The sensors may form part of the hearing system or be separate, individual, devices, or form part or other devices, e.g. a smartphone, or a wearable device.

The second processor may be configured to estimate data indicative of a location of said localized sound source S relative to the user based on the following expression for stacked residual vectors $r(S^e)$ originating from said time instances t=1, . . . , N $$r(S^e)=y_t^{ij}-h_{ij}(S^e,R_t,T_t^e)$$

where $S^e$ represent the position of said sound source in an inertial frame of reference, $R_t$ and $T_t^e$ are matrices describing a rotation and a translation, respectively, of the sensor array with respect to the inertial frame at time t, and $y_t^{ij}=\tau_{ij}+e_t$ represent said sensor array configuration specific data, where $\tau_{ij}$ represent said differences between a time of arrival of sound from said localized sound source S at said respective input transducers i, j, and $e_t$ represents measurement noise, where (i,j)=1, . . . , M, j>i, wherein $h_{ij}$ is a model of the time differences $\tau_{ij}$ between each microphone pair $p_i$ and $p_j$.

The second processor may form part of the hearing system, e.g. be included in a hearing device (or in both hearing devices of a binaural hearing system). Alternatively, the second processor may form part of a separate device, e.g. a smartphone or other (stationary or wearable) device in communication with the hearing system.

The second processor may be configured to solve the problem represented by the stacked residual vectors $r(S^e)$ in a maximum likelihood framework.

The second processor may be configured to solve the problem represented by the stacked residual vectors $r(S^e)$ using an Extended Kalman filter (EKF) algorithm.

The hearing system may comprise first and second hearing devices, e.g. hearing aids, adapted to be located at or in left and right ears of the user, or to be fully or partially implanted in the head at the left and right ears of the user. Each of the first and second hearing devices may comprise

- at least one input transducer for providing an electric input signal representing sound in said environment
- at least one output transducer for providing stimuli perceivable to the user as representative of said sound in the environment.

The at least one input transducer of said first and second hearing devices may constitute or form part of said sensor array.

Each of the first and second hearing devices may comprise circuitry (e.g. antenna and transceiver circuitry) for wirelessly exchanging one or more of said electric input signals, or parts thereof, with the other hearing device and/or with an auxiliary device. Each of the first and second hearing devices may be configured to forward one or more of said electric input signals (or parts thereof, e.g. selected frequency bands) to the respective other hearing device (possibly via an intermediate device) or to a separate (auxiliary) processing device, e.g. a remote control or a smartphone.

The hearing system may comprise a hearing aid, a headset, an earphone, an ear protection device or a combination thereof.

The first and second hearing devices may be constituted by or comprise respective first and second hearing aids.

The hearing system may be adapted to be body worn, e.g. head worn. The hearing system may comprise a carrier, e.g. for carrying at least some of the M input transducers of the sensor array. The carrier, e.g. a spectacle frame, may have a dimension larger than a typical hearing aid adapted to be located in or at an ear of a user, e.g. larger than 0.05 m, e.g. larger than 0.10 m. The carrier may have a curved or an angled (e.g. hinged) structure (as e.g. the frame of glasses). The carrier may be configured to carry at least some of the sensors (e.g. IMU-sensors) of the detector unit.

The form-factor of the carrier (e.g. a glasses frame) is important when it comes to embodying the input transducers and/or sensors (e.g. for M≥12 microphones). It is the physical distance between microphones that determines the beam width of a beam pattern generated from the electric input signals from the input transducers. The larger distance between the input transducers (e.g. microphones), the narrower a beam can be made. Narrow beams are generally not possible to generate in hearing aids (with form factors having maximum dimensions of a few centimeters). In an embodiment, the hearing system comprises a carrier having a dimension along a (substantially planar) curve (preferably following the curvature of a head of a user wearing the hearing system) allowing a minimum number $N_{IT}$ of input transducers to be (operationally) mounted. The minimum number $N_{IT}$ of input transducers may e.g. be 4 or 8 or 12. The minimum number $N_{IT}$ of input transducers may e.g. be equal to M, e.g. smaller than or equal to M. The carrier may have a longitudinal dimension of at least 0.1 m, such as at least 0.15 m, such as at least 0.2 m, such as at least 0.25 m.

Appropriate distances between the input transducers (e.g. microphones) of the hearing system may be extracted from current beamforming technologies (e.g. 0.01 m, or more). However, other direction of arrival (DOA) principles can be used that require much less spacing, e.g. smaller than 0.008 m, such as smaller than 0.005 m, such as smaller than 0.002 m (2 mm), see e.g. EP3267697A1.

In an embodiment, the carrier is configured to host one or more cameras (e.g. scene cameras, e.g. for Simultaneous Localization and Mapping (SLAM) and eye-tracking cameras for eye gaze, e.g. one or more high-speed cameras). The hearing system may comprise an eye-tracking camera, either together with or as an alternative to EOG sensors.

The scene camera may include face-tracking algorithms to give a position of the faces in the scene. Thereby (potential) localized sound sources can be identified (and a direction to or a location of such sound source be estimated).

In an embodiment, the hearing system comprises a combination of EOG (based on EOG sensors located in or on a hearing aid) for eye-tracking and a scene camera for SLAM (e.g. mounted on (top of) the hearing aid) in a hearing aid form factor (e.g. located in the housing of one or more hearing aids located in or at one or both ears of a user).

In an embodiment, the hearing system comprises a combination of EOG (based on EOG sensors, e.g. electrodes, or an eye tracking camera) for eye-tracking and a scene camera for SLAM combined with IMUs for motion tracking/head rotation.

By localizing the sound sources around the user (e.g. using SLAM), an impression of the original positions of the sound sources can be 'recreated' by applying standardized head related transfer functions (HRTFs). Since we know where in space the sources are (e.g. via SLAM), we can project the different sources to their 'original' positions when we present the sound to the left and right ears. In an embodiment, a database of head related transfer functions for different angles of incidence relative to a reference direction (e.g. a look direction of the user) is accessible to the hearing system (e.g. stored in a memory of the hearing system, or otherwise accessible to the hearing system).

The hearing system may comprise an auxiliary device comprising the second processor configured to estimate data indicative of a location of said localized sound source S relative to the user based on corresponding values of said location data and said sensor array configuration data at said different points in time t, t=1, . . . , N.

The auxiliary device may comprise the first processor for receiving said electric input signals and—in case said sound comprises sound from a localized sound source S—for extracting sensor array configuration specific data $\tau_{ij}$ of said sensor array indicative of differences between a time of arrival of sound from said localized sound source S at said respective input transducers, at said different points in time t, t=1, . . . , N.

The hearing system may comprise a hearing device (e.g. first and second hearing devices of a binaural hearing system) and an auxiliary device.

In an embodiment, the hearing system is adapted to establish a communication link between the hearing device and the auxiliary device to provide that information (e.g. control and status signals (e.g. including detector signals, e.g. location data), and/or possibly audio signals) can be exchanged or forwarded from one to the other.

In an embodiment, the hearing system comprises an auxiliary device, e.g. a remote control, a smartphone, or other portable or wearable electronic device, such as a smartwatch or the like.

In an embodiment, the auxiliary device is or comprises a remote control for controlling functionality and operation of the hearing device(s). In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SmartPhone, e.g. based on Bluetooth or some other standardized or proprietary scheme).

In an embodiment, the hearing system comprises two hearing devices adapted to implement a binaural hearing system, e.g. a binaural hearing aid system.

A Hearing Device:

In an embodiment, the hearing device is adapted to provide a frequency dependent gain and/or a level dependent compression and/or a transposition (with or without frequency compression) of one or more frequency ranges to one or more other frequency ranges, e.g. to compensate for a hearing impairment of a user. In an embodiment, the hearing device comprises a signal processor for enhancing the input signals and providing a processed output signal.

In an embodiment, the hearing device comprises an output unit for providing a stimulus perceived by the user as an acoustic signal based on a processed electric signal. In an embodiment, the output unit comprises a number of electrodes of a cochlear implant or a vibrator of a bone conducting hearing device. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

In an embodiment, the hearing device comprises an input unit for providing an electric input signal representing sound. In an embodiment, the input unit comprises an input transducer, e.g. a microphone, for converting an input sound to an electric input signal. In an embodiment, the input unit comprises a wireless receiver for receiving a wireless signal comprising sound and for providing an electric input signal representing said sound.

In an embodiment, the hearing device comprises a directional microphone system (e.g. a beamformer filtering unit) adapted to spatially filter sounds from the environment, and thereby enhance a target acoustic source among a multitude of acoustic sources in the local environment of the user wearing the hearing device. In an embodiment, the directional system is adapted to detect (such as adaptively detect) from which direction (DOA) a particular part of the microphone signal originates. In hearing devices, a microphone array beamformer is often used for spatially attenuating background noise sources. Many beamformer variants can be found in literature. The minimum variance distortionless response (MVDR) beamformer is widely used in microphone array signal processing. Ideally the MVDR beamformer keeps the signals from the target direction (also referred to as the look direction) unchanged, while attenuating sound signals from other directions maximally. The generalized sidelobe canceller (GSC) structure is an equivalent representation of the MVDR beamformer offering computational and numerical advantages over a direct implementation in its original form.

In an embodiment, the hearing device comprises an antenna and transceiver circuitry (e.g. a wireless receiver) for wirelessly receiving a direct electric input signal from another device, e.g. from an entertainment device (e.g. a TV-set), a communication device, a wireless microphone, or another hearing device. In an embodiment, the direct electric input signal represents or comprises an audio signal and/or a control signal and/or an information signal. In an embodiment, the hearing device comprises demodulation circuitry for demodulating the received direct electric input to provide the direct electric input signal representing an audio signal and/or a control signal e.g. for setting an operational parameter (e.g. volume) and/or a processing parameter of the hearing device. In general, a wireless link established by antenna and transceiver circuitry of the hearing device can be of any type. In an embodiment, the wireless link is established between two devices, e.g. between an entertainment device (e.g. a TV) and the hearing device, or between two hearing devices, e.g. via a third, intermediate device (e.g. a processing device, such as a remote control device, a smartphone, etc.). In an embodiment, the wireless link is used under power constraints, e.g. in that the hearing device is or comprises a portable (typically battery driven) device. In an embodiment, the wireless link is a link based on near-field communication, e.g. an inductive link based on an inductive coupling between antenna coils of transmitter and receiver parts. In another embodiment, the wireless link is based on far-field, electromagnetic radiation. In an embodiment, the communication via the wireless link is arranged according to a specific modulation scheme, e.g. an analogue modulation scheme, such as FM (frequency modulation) or AM (amplitude modulation) or PM (phase modulation), or a digital modulation scheme, such as ASK (amplitude shift keying), e.g. On-Off keying, FSK (frequency shift keying), PSK (phase shift keying), e.g. MSK (minimum shift keying), or QAM (quadrature amplitude modulation), etc.

Preferably, communication between the hearing device and the other device is based on some sort of modulation at frequencies above 100 kHz. Preferably, frequencies used to establish a communication link between the hearing device and the other device is below 70 GHz, e.g. located in a range from 50 MHz to 70 GHz, e.g. above 300 MHz, e.g. in an ISM range above 300 MHz, e.g. in the 900 MHz range or in the 2.4 GHz range or in the 5.8 GHz range or in the 60 GHz range (ISM=Industrial, Scientific and Medical, such standardized ranges being e.g. defined by the International Telecommunication Union, ITU). In an embodiment, the wireless link is based on a standardized or proprietary technology. In an embodiment, the wireless link is based on Bluetooth technology (e.g. Bluetooth Low-Energy technology).

In an embodiment, the hearing device is a portable device, e.g. a device comprising a local energy source, e.g. a battery, e.g. a rechargeable battery.

In an embodiment, the hearing device comprises a forward or signal path between an input unit (e.g. an input transducer, such as a microphone or a microphone system and/or direct electric input (e.g. a wireless receiver)) and an output unit, e.g. an output transducer. In an embodiment, the signal processor is located in the forward path. In an embodiment, the signal processor is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 48 kHz (adapted to the particular needs of the application) to provide digital samples $x_n$, (or x[n]) at discrete points in time $t_n$ (or n), each audio sample representing the value of the acoustic signal at $t_n$ by a predefined number $N_b$ of bits, $N_b$ being e.g. in the range from 1 to 48 bits, e.g. 24 bits. Each audio sample is hence quantized using $N_b$ bits (resulting in $2^{Nb}$ different possible values of the audio sample). A digital sample x has a length in time of $1/f_s$, e.g. 50 μs, for $f_s$=20 kHz. In an embodiment, a number of audio samples are arranged in a time frame. In an embodiment, a time frame comprises 64 or 128 audio data samples. Other frame lengths may be used depending on the practical application.

In an embodiment, the hearing devices comprise an analogue-to-digital (AD) converter to digitize an analogue input (e.g. from an input transducer, such as a microphone) with a predefined sampling rate, e.g. 20 kHz. In an embodiment, the hearing devices comprise a digital-to-analogue (DA) converter to convert a digital signal to an analogue output signal, e.g. for being presented to a user via an output transducer.

In an embodiment, the hearing device, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the (time-)frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. Typically, a sample rate $f_s$ is larger than or equal to twice the maximum frequency $f_{max}$, $f_s \geq 2f_{max}$. In an embodiment, a signal of the forward and/or analysis path of the hearing device is split into a number NI of frequency bands (e.g. of uniform width), where NI is e.g. larger than 5, such as larger than 10, such as larger than 50, such as larger than 100, such as larger than 500, at least some of which are processed individually. In an embodiment, the hearing device is/are adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, the hearing device comprises a number of detectors configured to provide status signals relating to a current physical environment of the hearing device (e.g. the current acoustic environment), and/or to a current state of the user wearing the hearing device, and/or to a current state or mode of operation of the hearing device. Alternatively or additionally, one or more detectors may form part of an external device in communication (e.g. wirelessly) with the hearing device. An external device may e.g. comprise another hearing device, a remote control, and audio delivery device, a telephone (e.g. a Smartphone), an external sensor, etc.

In an embodiment, one or more of the number of detectors operate(s) on the full band signal (time domain). In an embodiment, one or more of the number of detectors operate(s) on band split signals ((time-) frequency domain), e.g. in a limited number of frequency bands.

In an embodiment, the number of detectors comprises a level detector for estimating a current level of a signal of the forward path. In an embodiment, the predefined criterion comprises whether the current level of a signal of the forward path is above or below a given (L-) threshold value. In an embodiment, the level detector operates on the full band signal (time domain) In an embodiment, the level detector operates on band split signals ((time-) frequency domain).

In a particular embodiment, the hearing device comprises a voice detector (VD) for estimating whether or not (or with what probability) an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only (or mainly) comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, the number of detectors comprises a movement detector, e.g. an acceleration sensor, e.g. a liner acceleration or a rotation sensor (e.g. a gyroscope). In an embodiment, the movement detector is configured to detect, such as record, a movement of the user over time, e.g. from a known start point.

In an embodiment, the hearing device comprises a classification unit configured to classify the current situation based on input signals from (at least some of) the detectors, and possibly other inputs as well. In the present context 'a current situation' is taken to be defined by one or more of a) the physical environment (e.g. including the current electromagnetic environment, e.g. the occurrence of electromagnetic signals (e.g. comprising audio and/or control signals) intended or not intended for reception by the hearing device, or other properties of the current environment than acoustic);

b) the current acoustic situation (input level, feedback, etc.), and c) the current mode or state of the user (movement, temperature, cognitive load, etc.);

d) the current mode or state of the hearing device (program selected, time elapsed since last user interaction, etc.) and/or of another device in communication with the hearing device.

In an embodiment, the hearing device further comprises other relevant functionality for the application in question, e.g. compression, noise reduction, feedback suppression, etc.

In an embodiment, the hearing device comprises a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof. In an embodiment, the hearing device comprises a speakerphone (comprising a number of input transducers and a number of output transducers, e.g. for use in an audio conference situation), e.g. comprising a beamformer filtering unit, e.g. providing multiple beamforming capabilities.

A Method:

In an aspect, a method of operating a hearing system adapted to be worn by a user and configured to capture sound in an environment of the user, when said hearing system is operationally mounted on the user is furthermore provided by the present application. The hearing system comprises a sensor array ofM input transducers, e.g. microphones, where M≥2, each for providing an electric input signal representing said sound in said environment, said input transducers $p_i$, i=1, . . . M, of said array having a known geometrical configuration relative to each other, when worn by the user. The method comprises detecting movements over time of the hearing system when worn by the user, and providing location data of said sensor array at different points in time t, t=1, . . . , N; and in case said sound comprises sound from a localized sound source S—extracting sensor array configuration specific data $\tau_{ij}$ of said sensor array indicative of differences between a time of arrival of sound from said localized sound source S at said respective input transducers, at said different points in time t, t=1, . . . , from said electric input signals; and estimating data indicative of a location of said localized sound source S relative to the user based on corresponding values of said location data and said sensor array configuration data at said different points in time t, t=1, . . . , N.

It is intended that some or all of the structural features of the system described above, in the 'detailed description of embodiments' or in the claims can be combined with embodiments of the method, when appropriately substituted by a corresponding process and vice versa. Embodiments of the method have the same advantages as the corresponding system.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Computer Program:

A computer program (product) comprising instructions which, when the program is executed by a computer, cause the computer to carry out (steps of) the method described above, in the 'detailed description of embodiments' and in the claims is furthermore provided by the present application.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

An APP:

In a further aspect, a non-transitory application, termed an APP, is furthermore provided by the present disclosure. The APP comprises executable instructions configured to be executed on an auxiliary device to implement a user interface for a hearing device or a hearing system described above in the 'detailed description of embodiments', and in the claims. In an embodiment, the APP is configured to run on cellular phone, e.g. a smartphone, or on another portable device allowing communication with said hearing device or said hearing system.

Definitions:

In the present context, a 'hearing device' refers to a device, such as a hearing aid, e.g. a hearing instrument, or an active ear-protection device, or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with an output transducer, e.g. a loudspeaker, arranged close to or in the ear canal, as a unit entirely or partly arranged in the pinna and/or in the ear canal, as a unit, e.g. a vibrator, attached to a fixture implanted into the skull bone, as an attachable, or entirely or partly implanted, unit, etc. The hearing device may comprise a single unit or several units communicating electronically with each other. The loudspeaker may be arranged in a housing together with other components of the hearing device, or may be an external unit in itself (possibly in combination with a flexible guiding element, e.g. a dome-like element).

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit (e.g. a signal processor, e.g. comprising a configurable (programmable) processor, e.g. a digital signal processor) for processing the input audio signal and an output unit for providing an audible signal to the user in dependence on the processed audio signal. The signal processor may be adapted to process the input signal in the time domain or in a number of frequency bands. In some hearing devices, an amplifier and/or compressor may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output unit may comprise an output transducer, such as e.g. a loudspeaker for providing an air-borne acoustic signal or a vibrator for providing a structure-borne or liquid-borne acoustic signal. In some hearing devices, the output unit may comprise one or more output electrodes for providing electric signals (e.g. a multi-electrode array for electrically stimulating the cochlear nerve). In an embodiment, the hearing device comprises a speakerphone (comprising a number of input transducers and a number of output transducers, e.g. for use in an audio conference situation).

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory brainstem, to the auditory midbrain, to the auditory cortex and/or to other parts of the cerebral cortex.

A hearing device, e.g. a hearing aid, may be adapted to a particular user's needs, e.g. a hearing impairment. A configurable signal processing circuit of the hearing device may be adapted to apply a frequency and level dependent compressive amplification of an input signal. A customized frequency and level dependent gain (amplification or compression) may be determined in a fitting process by a fitting system based on a user's hearing data, e.g. an audiogram, using a fitting rationale (e.g. adapted to speech). The frequency and level dependent gain may e.g. be embodied in processing parameters, e.g. uploaded to the hearing device via an interface to a programming device (fitting system), and used by a processing algorithm executed by the configurable signal processing circuit of the hearing device.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. SmartPhones), or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person. Hearing devices or hearing systems may e.g. form part of or interact with public-address systems, active ear protection systems, handsfree telephone systems, car audio systems, entertainment (e.g. karaoke) systems, teleconferencing systems, classroom amplification systems, etc.

Embodiments of the disclosure may e.g. be useful in applications such as portable audio processing devices, e.g. hearing aids.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Figure 1A:
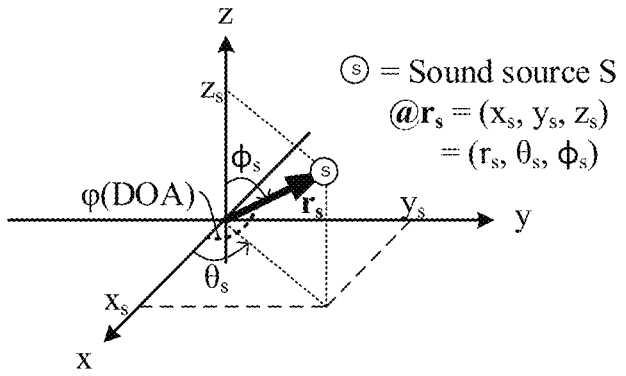
FIG. 1A shows a sound source located in a three dimensional coordinate system defining Cartesian (x, y, z) and spherical (r, θ, ϕ) coordinates of the sound source.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of hearing devices, e.g. hearing aids, to hearing systems, e.g. to binaural hearing aid systems Direction Of Arrival (DOA) estimation and source-location estimation are becoming increasingly important. Some examples are power saving and user tracking in WiFi access points and Mobile cell towers, detection and tracking of acoustic sources. With modern array processing techniques applications such as Massive Multiple Input Output (M-MIMO) and Active Electronically Scanned Array (AESA) Radars can steer the output energy or the antenna sensitivity in the desired direction. Both AESA and M-MIMO are based on planar arrays yielding directionality in azimuth and elevation. However, some system may be limited to linear arrays for computing the DOA, e.g., Binural Hearing Aid Systems (HAS) which use one microphone per ear and towed arrays in deep-sea exploration can only estimate one angle.

In this disclosure, linear arrays with two or more sensors receiving a signal from a source are considered. When the sensors are equidistantly spaced a so called uniform linear array (ULA) is obtained and it gives a uniform spatial sampling of the wavefield. This sampling eases non-parametric narrowband DOA methods, such as MUltiple SIgnal Classification (MUSIC) and Minimum Variance Distortionless Response (MVDR), as they seek the direction with strongest power.

To overcome the limitations of linear arrays several methods has been proposed in order to estimate the 3D source direction or its full position. A chest-worn planar microphone array may be used to estimate the direction, while Head-Related Transfer Functions (HRTFs) are used to estimate the position.

The proposed methods utilize the geometrical properties of the array when subject to motion. The aperture is the space occupied by the array and the simple idea utilized here is that the motion of the array synthesize a larger space. A nonlinear least-squares (NLS) formulation utilizing known motion is proposed and two sequential solutions are proposed. The formulation is extended to include uncertainty in the motion allowing estimation of source locations and the motion simultaneously.

FIG. 1A shows a sound source S located in a three dimensional coordinate system defining Cartesian (x, y, z) and spherical (r, θ, φ) coordinates of the sound source S. A direction of arrival (DOA) of sound from the sound source S at a microphone array located along the x-axis is defined by the angle between the sound source vector $r_s$ and microphone axis (x), indicated by bold dashed arc 'DOA'.

Figure 1B:
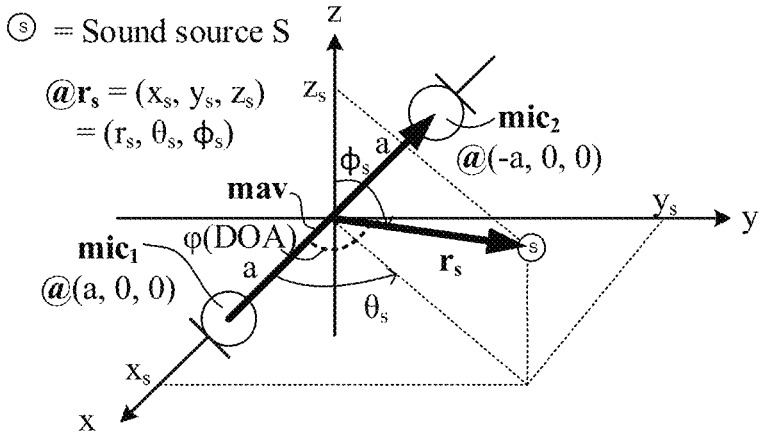
FIG. 1B shows a sound source located in a three dimensional coordinate system relative to a microphone array comprising two microphones located on the x-axis symmetrically around origo of the coordinate system (the microphones being e.g. located in each their left and right hearing device)

FIG. 1B shows a sound source S located in a three dimensional coordinate system (x, y, z) relative to a microphone array comprising two microphones ($mic_1$, $mic_2$) located a distance d=2a apart on the x-axis symmetrically around origo (0, 0, 0) of the coordinate system (i.e. centred in (a, 0, 0) and (−a, 0, 0), respectively. The angle between the sound source vector $r_s$ and the microphone array vector may (termed the DOA array vector) is indicated in FIG. 1B by bold dashed arc 'φ(DOA)'. The microphones are e.g. located in each their left and right hearing device, or are e.g. both located in the same hearing device.

The setting illustrated in FIG. 1B is a linear array with two sensors (here microphones) receiving a signal from a sound source S. For simplicity, a free field assumption is made which result in unobstructed waves impinging the array. It is also assumed that wave-front is planar.

When the sources are not perpendicular to the array, the distance between the sensors and the source will be different resulting in a time difference in the received signals. With known speed of the medium (here e.g. air), the time difference can be converted to a distance and with known separation between the sensors, the angle to the source can be calculated.

Figure 1C:
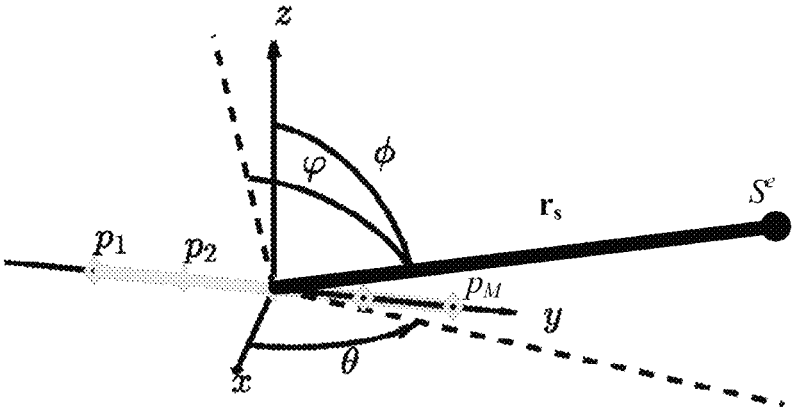
FIG. 1C is a further illustration of an example of the geometry of 3D direction of arrival, where the bold line is the direction to the source, $S^e$, depicted with a solid dot (•), the diamonds on the line coinciding with the y-axis represents sensor nodes (e.g. microphone locations), $p_i$, i=1, . . . , M, θ is the azimuth angle, φ is the elevation angle, and ϕ is the broadside angle.

FIG. 1C is a further illustration of an example of the geometry of 3D direction of arrival, where the bold line is the direction to the source, $S^e$, depicted with a solid dot (•), the diamonds on the line coinciding with the y-axis represents sensor nodes (e.g. microphone locations), $p_i$, $i=1, \ldots, M$, $\theta$ is the azimuth angle, $\phi$ is the elevation angle, and $\varphi$ is the broadside angle.

For simplicity, a free field assumption is made which result in unobstructed waves impinging the array. It is also assumed that wave-front is planar. When the sources are not perpendicular to the array the distance between the sensors and the source will be different resulting in a time difference in the received signals. With known speed of the medium the time difference can be converted to a distance and with known separation between the sensors the angle to the source can be calculated.

When the sensors are not necessarily equidistantly spaced the DOA on a linear sensor array, as illustrated in FIG. 1C, can be described by $$\sin\varphi = \frac{c\tau_{ij}}{\|p_i - p_j\|} \tag{1}$$

where $\varphi \in [-90°, 90°]$ is the DOA, $\tau_{ij}$ is the time difference of between the signal at each sensor $p_i$ and $p_j$ with distance $\|p_i-p_j\|$, and c is the transmission speed of the medium (e.g. air). Time difference measurements can be for instance obtained with time-domain methods based Generalized Cross Correlation (cf. e.g. [Knapp & Carter; 1976]).

A common setting is to consider the array and DOA source all lying in the same plane (e.g. the xy-plane in FIG. 1B. However, a more general case is to consider the array as a vector in $\mathbb{R}^3$ and the source as a point in the same space, as illustrated in FIG. 1C. Then the DOA is the angle between the vector from the source to the origin of the array, and the array itself (cf. e.g. FIG. 1B). This is of course nothing but the scalar product, also known as the inner product. It is also common to consider the angle the source vector makes to a vector perpendicular to the array. This angle is called the broadside angle and it is zero for sources perpendicular to the array (along the z-axis in FIG. 1C), i.e., it is the sinus of the scalar product.

The source direction then has two degrees of freedom (DOF), namely, the azimuth ($\theta$) and polar (or elevation) ($\phi$) angles, see e.g. FIG. 1B, 1C. The distance to the source cannot be obtained from angular measurements without translation of the array. When the elevation angle ($\phi$) is zero then the azimuth ($\theta$) and the broadside angles are the same.

A body fixed coordinate (b) frame containing the array at which the sensor nodes are located with $X^b$ in $\mathbb{R}^3$ is defined. The orientation of the b frame with respect to an inertial frame of reference (e) is described with a rotation matrix $\{R \in \mathbb{R}^{3\times3};\ \det R=1;\ R^T=R^{-1}\}$. Hence, for pure orientation changes, vectors between these frames are related by $X^b=RX^e$ and trivially $X^e=R^1\ X^b=R^T\ X^b$. Denote the translation, i.e., the position, of the array vector with $T^e \in \mathbb{R}^3$ and the position of point source by $S^e \in \mathbb{R}^3$, then the source expressed in the b frame is $$S^b=R(S^e-T^e). \tag{2}$$

Figure 2:
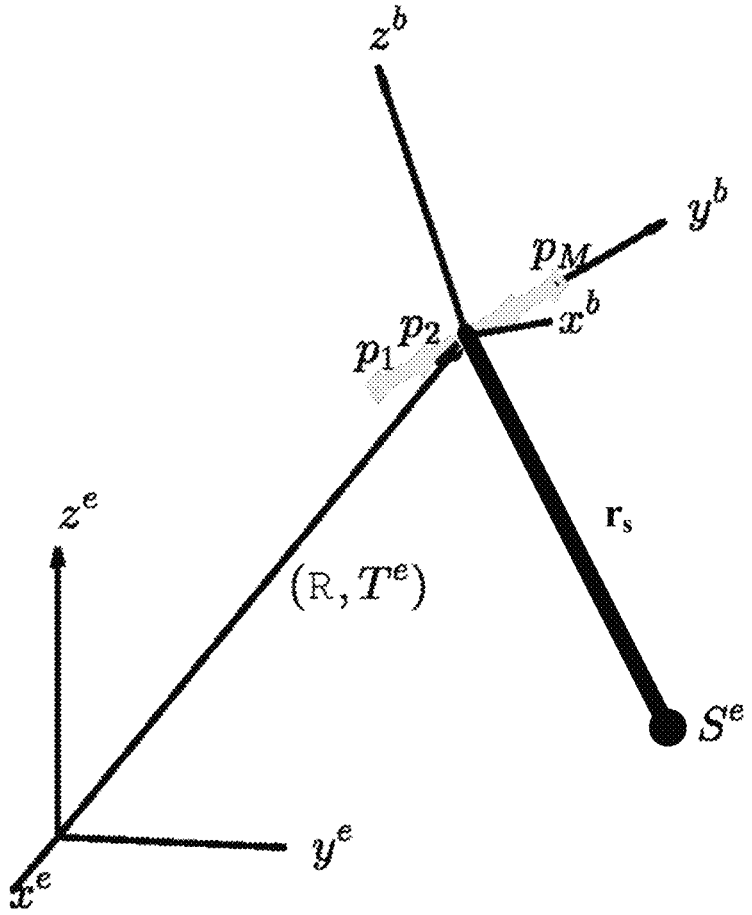
FIG. 2 shows an illustration of the orientation, R, and position, $T^e$, of the array ($p_1, p_2, \ldots, p_M$) with respect to the e frame of reference.

This rigid body transformation of the array vector and the position of the source is illustrated in FIG. 2.

FIG. 2 is an illustration of the orientation, R and position $T^e$ of the sensor array $(p_1, p_2, \ldots, p_M)$ with respect to the e frame of reference. The body fixed array vector is aligned with the $y^b$ vector. The source location, $S^e$, is illustrated with a solid dot (•).

Let the pairwise difference between the Mnodes be denoted by $X_{ij}{}^b=p_i-p_j \in \mathbb{R}^3$, $(i, j)=1, \ldots, M$, $j>i$. The DOA in the b-frame is the scalar product between the vectors $X_{ij}{}^b$ and $S^b$. Using eq. (1), the time difference measurement can be expressed as $$\tau_{ij} = \frac{(S^b)^T X_{ij}^b}{\|S^b\|c} = \frac{(R(S^e - T^e))^T X_{ij}^b}{\|R(S^e - T^e)\|c} = h_{ij}(S^e, R, T^e) \tag{3}$$

where $h_{ij}$ is a model of the time differences $\tau_{ij}$ between each microphone pair $p_i$ and $p_j$. Thus, the time difference between each node pair can be expressed as a nonlinear function of the source position, the array length, its position and orientation. Furthermore, with $S^e=[x,y,z]$, the azimuth and elevation angles can be defined as $$\phi = \arctan\frac{y}{z}$$

and $$\theta = \arccos\frac{z}{\|S^e\|}$$

respectively.

The unknown variable $S^e$ only has two DOF since distance is not observed and it is therefore convenient to assume $\|S^e\|=1$. In this case, the DOA measurements and the measurement function corresponds to a system of nonlinear equations.

Rotation only: If there is no translation i.e., $T_t^e=0$, $t=1, \ldots, N$, then the distance to the source cannot be found. Hence, $S^e$ has two DOF and can only be determined up to an unknown scale. In the case that there is only one measurement, N=1, the nonlinear system is underdetermined since max rank H=1. In the case $N\geq2$, there exists a search direction, by the corresponding normal equations, only if rank H=2, since this is also the DOF of the unknown parameter $S^e$. The rank of the Jacobian is a function of the rotation and the location of the source.

As discussed earlier, the general DOA problem has geometrical ambiguities resulting in rotational invariance for certain configurations. This invariance means that DOA remains the same since the relative distance to the source is not changed by the rotation.

A rotation around the DOA array itself corresponds to a change in pitch. This is because any vector is rotationally invariant to rotations around its own axis i.e., $X^b=R(X^b)X^b$, where $R(X^b)$ denotes a rotation around the vector $X^b$. Thus, for rotations around the DOA array the two angles to the source cannot be resolved.

Rotation and translation: When there is translation of the array, then all three DOF of $S^e$ can be considered on the basis of triangulation. Assume that $X^b$ undergoes known rotation and translation $\{R_t, T_t^e, t=1, \ldots, N\}$ and there is a set of DOA measurements, as before. The corresponding measurement function (3) is parametrized by $h(S^e, R_t; T_t^e)$. The basic requirement is that the number of measurements are greater or equal than the DOF, i.e., $N \geq 3$. The motion resulting in rank $H<3$ from which a search direction cannot be found is translation along vectors parallel to $S^e$-$T^e$ with any rotation. This result is immediate from (2) since the only information about $S^e$ that affects the measurements (3) are related to orientation changes. From the discussion, it was established that orientation could only contribute to finding two DOF of $S^e$. The intuition is that such motion does not result in any parallax which is needed for triangulation.

Estimation:

Assume that all rotations and translations (the pose trajectory) $\{R_t, T_t^e, t=1, \ldots, N\}$ of the array vector $X^b$ are available (e.g. from movement monitoring sensors, such as IMUs), and there is a corresponding set of time difference measurements (e.g. based on maximizing respective correlation estimates between the signals in question)

$$\{y_t^{ij}=\tau_{ij}+e_t,(i,j)=1,\ldots M,j>i,t=1,\ldots,N\}$$

Here $y_t^{ij}$ is the measurement at the $i^{th}$ node compared to node j at time t such that j>i and $e_t$ is noise. The collection of measurements at each time t is called a snap-shot. With a stationary source $S^e$ the stacked residual vector for one time instant t=1 can be written as $$r(S^e)=\begin{bmatrix} y_1^{12} & - & h_{12}(S^e, R_1, T_1^e) \\ y_1^{13} & - & h_{13}(S^e, R_1, T_1^e) \\ \vdots & - & \vdots \\ y_1^{1M} & - & h_{1M}(S^e, R_1, T_1^e) \\ y_1^{23} & - & h_{23}(S^e, R_1 T_1^e) \\ y_1^{24} & - & h_{24}(S^e, R_1, T_1^e) \\ \vdots & & \vdots \\ y_1^{2M} & & h_{2M}(S^e, R_1 T_1^e) \\ \vdots & & \vdots \\ y_1^{(M-1)M} & - & h_{(M-1)M}(S^e, R_1, T_1^e) \end{bmatrix} \tag{4}$$

And by stacking the N residual vectors (for t=1, . . . , N), we obtain $$r(S^e)=[r_1(S^e)^T, \ldots, r_N(s^e)^T]^T \tag{5}$$

where $r(S^e) \in \mathbb{R}^{B\times 1}$ and $B=N\times\Sigma_{i=1}^{M-1}i$. The squared from of (5) is $$V(S^e)=\|r(S^e)\|_2^2 \tag{6}$$

which is nonlinear least-squares (NLS) formulation. NLS problems are readily solved using e.g., the Levenberg-Marquardt (LM) method, cf. e.g. [Levenberg; 1944], [Marquardt; 1963]. LM uses only gradient information to perform a quasi-Newton search. The gradient of (6) is $$\frac{dV(S^e)}{dS^e}=Hr \in \mathbb{R}^{3\times 1}$$

where H is the Jacobian, i.e., the matrix of first order partial derivatives dr(Se)

$$\frac{dr(S^e)}{dS^e}=H \in \mathbb{R}^{3\times B}$$

It is also preferable to use a weighting strategy for the NLS problem by taking into account that the measurement noise may vary over the time, and/or be different. The corresponding residuals in (6) are then weighted by the inverse of the measurement covariance $r_t R_t^{-1}$ or the whole batch as $$V_R(S^e)=\|r(S^e)\|_{R^{-1}}^2 \tag{7}$$

where $R=\mathrm{diag}(R_1, \ldots, R_B)$. When the measurement errors are Gaussian, $e_t \sim \mathcal{N}(0, R)$, then cost function (7) corresponds to the Maximum Likelihood (ML) criterion.

The array is said to be unambiguous if the spatial distribution of the nodes yields a well-defined estimation problem. It turns out that there are two motions for which the array is ambiguous and the $S^e$ cannot be estimated. The first is rotation only (RO) for which only the source direction can be found as long as the rotation is not around the array axis. The second is rotation and translation (RT) of the array. From such general motion the source location is implicitly triangulated by the NLS solution as long as the translation is non-parallel to $S^e$-$T^e$.

Target tracking and SLAM: With the NLS problem defined for a stationary source and known motion of the array, it is straightforward to define more challenging cases. If the source is allowed to move, then the parameter $S^e$ is changed to be time-varying $S_t^e$, t=1, . . . , Nin eq. (6) and the problem is that of 'target tracking'. This is not well-defined since there are more DOFs in the parameter than what can be obtained in the measurements. A remedy may be to include a dynamic model of the parameter into the residual.

$$V_R^{TT}(S_t^e)=\left\|\begin{bmatrix} r(S_t^e) \\ X_{t+1}-FX_t \end{bmatrix}\right\|_{diag(R^{-1},Q^{-1})}^2 \tag{8}$$

where $$X_{t+1}=\mathrm{vec}\ S_i^e, i=2, \ldots, N+1, F=I_{3N}, X_i=\mathrm{vec}\ S_i^e, i=1, \ldots, N$$

And Q is a diagonal covariance matrix of appropriate dimension. In an embodiment, Q is large.

When there is uncertainty in both the position of sources and the motion of the array a Simultaneous Localization and Mapping (SLAM) problem is obtained. The Maximum Likelihood (ML) version of SLAM does not consider any motion model and thus the following NLS problem is obtained $$V_R(S_k^e, T_t^e, R_t)=\|r(S_k^E, T_t^e, R_t)\|_{R^{-1}}^2 \tag{9}$$

and there are K stationary sources $S_k^e$, k=1, . . . , K. This kind of formulation is common in computer vision where it is called Bundle Adjustment.

Sequential solutions: In many applications it is desired to process data in an on-line fashion. By construction, NLS is an off-line solution but sequential recursive methods are easily derived thereof. A well known algorithm is the Extended Kalman filter (EKF) [Jazwinski; 1970], which can be viewed as a special case of NLS without iterations. This naturally leads to iterated solutions which, in general, result in an increased performance. In order to compute a search direction for the RO case, at least two snapshots are needed at each update. Similarly, at least three snapshots are needed in the RT case.

Sequential Nonlinear Least-Squares: A simple sequential NLS (S-NLS) solution can be done as follows. Given an initial guess $(x)^0$ of the unknown parameter x then, for an appropriate number of snapshots iterate $$x_{i+1}=x_i+\alpha_i(H^TH)^{-1}Hr \tag{10}$$

until convergence. Here H and r are parametrized by the current iterate $x_i$, and $\alpha_i \in [0, 1]$ is a step-size, which can be computed with e.g., backtracking. In the RO case ($x=S^e$), then x can only be estimated up to scale and therefore the estimate should be normalized at each iteration as $$x_{i+1} := \frac{x_{i+1}}{\|x_{i+1}\|} \tag{11}$$

Iterated Extended Kalman filter: State space models are an important tool as they admit dynamic assumptions on the otherwise stationary parameter through a process model. As usual, the state is assumed to evolve according to some process model $$x_{t+1}=f(x_t, w_t), \tag{12}$$

where $w_t$ is process noise. The iterated Extended Kalman filter (IEKF) can be seen as an NLS solver for state space models. IEKF generally obtains smaller residual errors and is to prefer over the standard EKF when the nonlinearities are severe and computational resources are available. The iterations are performed in the measurement update where the Minimum a posteriori (MAP) cost function is minimized with respect to the unknown state. The cost function can be used to ensure cost decrease and when the iterations should terminate. A basic version of the measurement update in IEKF is summarized in Algorithm 1. For a complete description and other options.

Algorithm 1 Iterated Extended Kalman Measurement Update:

Require an initial state, $\hat{x}_{0|0}=(x)^0\neq T^e$, and an initial state covariance, $\hat{P}_{0|0}$.

1. Measurement update iterations $$H_i = \frac{\partial h(s)}{\partial s}\bigg|_{s=x_i} \tag{13a}$$

$$K_i = \hat{P}_{t|t-1}H_i^T\left(H_i\hat{P}_{t|t-1}H_i^T + R_t\right)^{-1} \tag{13b}$$

$$x_{i+1} = x_i + \alpha_i(\hat{x} - x_i + K_i(y_t - h(x_i) - H_i(\hat{x} - x_i))) \tag{13c}$$

2. Update the state and the covariance $$\hat{x}_{t|t}=x_{i+1}, \tag{14a}$$

$$\hat{P}_{t|t}=(I-K_tH_t)\hat{P}_{t|t-1} \tag{14b}$$

Example Stationary Target

With a stationary target initialized at $S^e=[10, 10, 10]^T+w$, where $w \sim \mathcal{N}(0_{3\times1}, I_3)$, the cases of rotation only (RO) and rotation and translation (RT) are evaluated in a Monte Carlo (MC) fashion. For each case, the measurements are from an array with M=2 with $\|p_1-P_2\|=0.3$ giving $y_t=\tau_{12}+e_t$, t=1, . . . , 31, where $e_t \sim \mathcal{N}(0,0.01)$. The rotation sequence is given by a roll pitch and yaw motion as $R_t=[0, 0, 0]^T\rightarrow[30, 30, 30]^T$ [°] in increments of one degree. The translation sequence is $T_t^e=[0, 0, 0]^T\rightarrow[0, 0.3, 0.3]^T$ [m] in increments of 0.01 m for the yz coordinates. For both cases, twenty runs where made and all estimators where run until no significant progress could be made. The dynamic model used in IEKF is constant position $x_{t+1}=x_t+w_t$, where $w_t \sim \mathcal{N}(0, Q=0.01I_3)$. The measurement covariance R=0.01I, where I is either $I_2$ for RO or $I_3$ for RT. For all three methods, a fixed step size $\alpha=0.5$ where chosen, and the initial point in each MC iterate was $(S^e)^0=S^3+w^{init}$, where $w^{init} \sim \mathcal{N}(0, 0.5^2I_3)$. In Table 1, the RMSE over the MC estimation results from the proposed methods on the two cases are shown. All three methods work fine and, as expected, the two sequential solutions perform slightly worse than NLS.

TABLE 1

RMSE of estimates obtained with the proposed methods for the case of rotation only and the case of rotation and translation.

| Method/Case | NLS | S-NLS | IEKF |
|---|---|---|---|
| RO | 0.0069 | 0.1526 | 0.2222 |
| RT | 0.5737 | 0.7298 | 0.6762 |

Example (Fixed Microphone Distance):

The direction of arrival (DOA) of a soundwave, assumed to be a free-field and planar wave front, impinging the array can be described by $$\sin\varphi = \frac{(R(S^e - T^e))^T X^b}{\|R(S^e - T^e)\|d} = h(S^e, R, T^e). \tag{1'}$$

Where φ represents the DOA, R is the 3D orientation of the array, $S^e$ ($=(x_s, y_s, z_s)$ in FIG. 1B) is the position of the sound source where superscript e denotes an inertial reference frame, $T^e$ is the position of the array (=(0, 0, 0) in FIG. 1B), $X^b$ (=−2a, 0, 0) is the array vector described in the body fixed coordinate frame and d (=2a in FIG. 1B) is the length of the array, i.e. (here with two microphones), the distance between the microphones. The nonlinear expression can be stacked into a nonlinear equation system $$r(S^e) = \begin{bmatrix} y_1 - h(S^e, R_1, T_1^e) \\ \vdots \\ y_N - h(S^e, R_N, T_N^e) \end{bmatrix}, \tag{4'}$$

where the y's are the DOA measurements found via e.g., delay-and-sum or beamforming. Then the two-norm of the residual vector $r(S^e)$ can be solved for in two scenarios:

1. Given two, or more, DOA measurements from distinct orientations, which are not a rotation around the array axis $X^b$, then the corresponding equation system can be solved with respect to $S^e$. In this scenario, only the direction, φ, θ to the source can be found, i.e., not the distance r. This method requires that the orientation of the array can be computed. This can be done using inertial measurement units (IMU), e.g. a 3D-gyroscope and/or a 3D-accelerometer.

2. Given three, or more, DOA measurements at distinct positions, and the translation is not along the DOA vector, then the corresponding equation system can be solved with respect to $S^e$. In this scenario the full three degrees of freedom of the system can be found. This method requires that the position of the array can be computed. This can be done using the IMU over short time intervals.

The minimization procedure can be any nonlinear least squares (NLS) method such as Levenberg-Marquardt or standard NLS with line-search.

Figure 3:
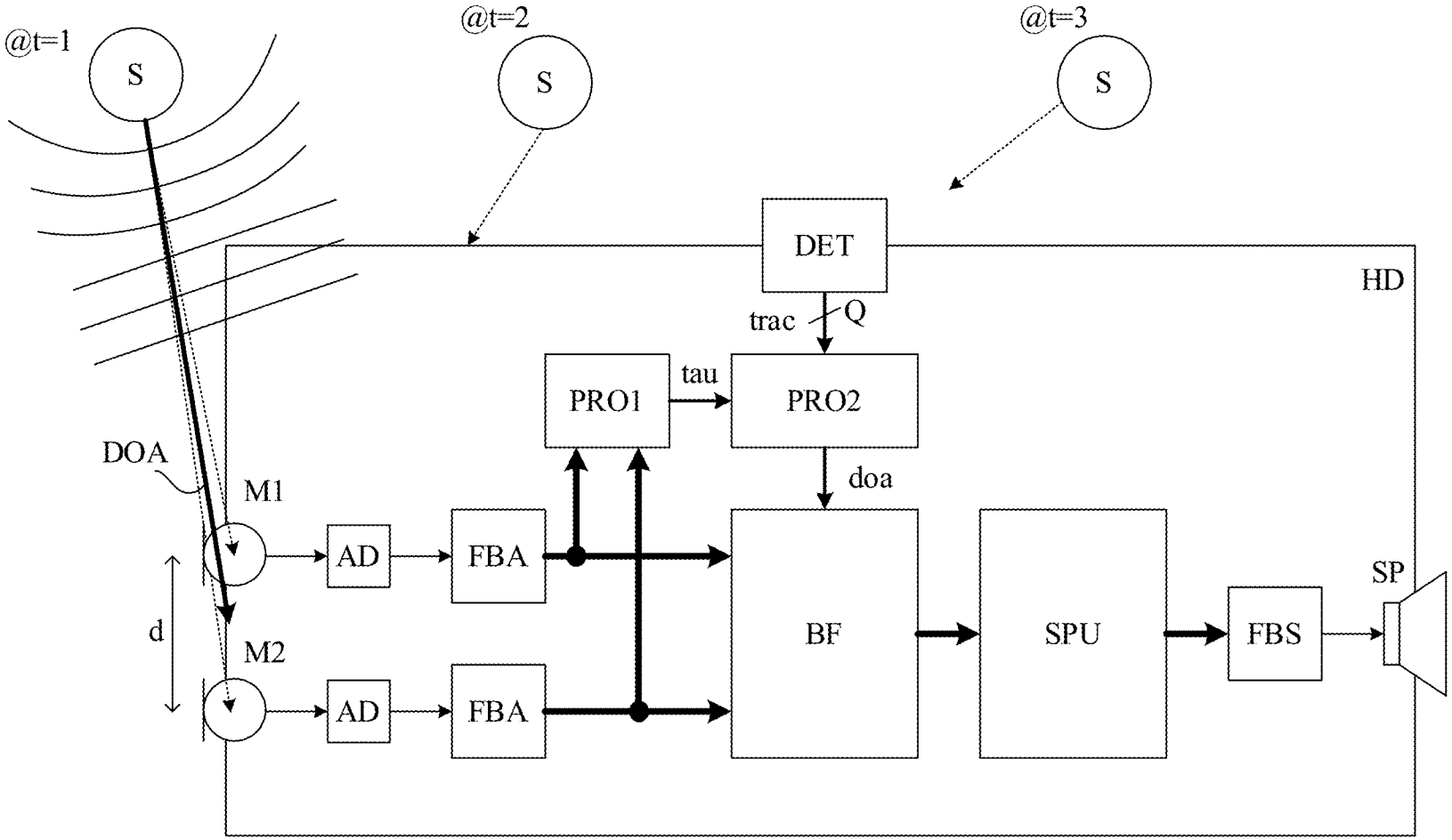
FIG. 3 shows a first embodiment of a hearing system according to the present disclosure.

FIG. 3 shows a first embodiment of a hearing system according to the present disclosure. The hearing system (HD) is adapted to be worn by a user and configured to capture sound in an environment of the user, when the hearing system is operationally mounted on the user's head. The hearing system comprises a sensor array of M=2 input transducers, here microphones M1, M2. Each microphone provides an electric input signal representing sound in the environment. The input transducers of the array have a known geometrical configuration relative to each other, when worn by the user (here defined by microphone distance d between M1 and M2). Each microphone path comprises an analogue to digital converter (AD) for sampling an analogue electric signal, thereby converting it to a digital electric input signal (e.g. using a sampling frequency of 20 kHz or more). Each microphone path further comprises an analysis filter bank (FBA) for providing a digitized electric input signal in a number of frequency sub-bands (e.g. K=64 or more). Each frequency sub-band signal (e.g. represented by index k) may comprise a time-variant complex representation of the input signal in successive time instances m, m+1, . . . (time frames).

The hearing system further comprises a detector unit (DET) (or is configured for receiving corresponding signals from separate sensors) for detecting movements over time of the hearing system when worn by the user, and providing location data of said sensor array at different points in time t, t=1, . . . , N. The detector (DET) provides data indicative of a track of the user (hearing system) relative to the sound source (cf. signal(s) trac, e.g. from Q different sensors or comprising Q different signals)

The hearing system further comprises a first processor (PRO1) for receiving said electric input signals and—in case said sound comprises sound from a localized sound source S—for extracting sensor array configuration specific data $\tau_{ij}$ (cf. signal tau) of the sensor array indicative of differences between a time of arrival of sound from the localized sound source S at said respective input transducers (M1, M2), at different points in time t, t=1, . . . , N.

FIG. 3 illustrates propagation paths (in a plane wave approximation (acoustic far-field)) from the localized sound source (S), e.g. a talker, situation at time t=1. It can be seen that sound from source S will arrive later at the second microphone M2 than at the first microphone M1. The time difference, denoted $\tau_{12}$ is determined in the first processor based on the two electric input signals (e.g. determining the time difference, $\tau_{12}$, as the time that maximizes a correlation measure between the two electric input signals). A movement of the user and the sound source (S) relative to each other is schematically indicated by the spatial displacement of the sound source S indicated by time instants t=2 and t=3, respectively.

The hearing system further comprises a second processor (PRO2) configured to estimate data indicative of a location of said localized sound source S relative to the user based on corresponding values of said location data and said sensor array configuration data at said different points in time t, t=1, . . . , N. The data indicative of a location of said localized sound source S relative to the user may e.g. be a direction of arrival (cf. signal doa from the processor (PRO2) to the beamformer filtering unit BF)

The embodiment of a hearing system in FIG. 3 further comprises (as already mentioned) a beamformer filtering unit (BF) for spatially filtering the electric input signals from microphones M1 and M2 and providing a beamformed signal. The beamformer filtering unit (BF) is a 'customer' of location data from the second processor (PRO2) to allow the generation of a beamformer that attenuates signals from the sound source S less than signals from other directions (e.g. an MVDR beamformer, cf. e.g. EP2701145A1). In the embodiment of FIG. 3 the beamformer filtering unit (BF) receives data indicative of a direction of arrival of the (target) sound relative to the user (and thus to the sensor array M1, M2) as indicated in FIG. 3 (solid arrow denoted DOA from S to midway between M1 and M2). Alternatively, the beamformer filtering unit (BF) may receive a location of the target sound source (s), e.g. including a distance from source (s) to user.

The embodiment of a hearing system in FIG. 3 further comprises signal processor (SPU) for processing the spatially filtered (and possibly further noise reduced signal) from the beamformer filtering unit in a number of frequency sub-bands. The signal processor (SPU) is e.g. configured to apply further processing algorithms, e.g. compressive amplification (to apply a frequency and level dependent amplification or attenuation to the beamformed signal), feedback suppression, etc. The signal processor (SPU) provides a processed signal that is fed to synthesis filter bank (FBS) for conversion from the time frequency domain to the time domain. The output of the synthesis filter bank (FBS) is fed to an output unit (here a loudspeaker) for providing stimuli representative of sound to the user (based in the electric input signals representative of sound in the environment).

The embodiment of a hearing system in FIG. 3 may be partitioned in different ways. In an embodiment, the hearing system comprises first and second hearing devices adapted for being located around left and right ears of the user (e.g. so that the first and second microphones (M1, M2) are located the left and right ears of the user, respectively.

Figure 4:
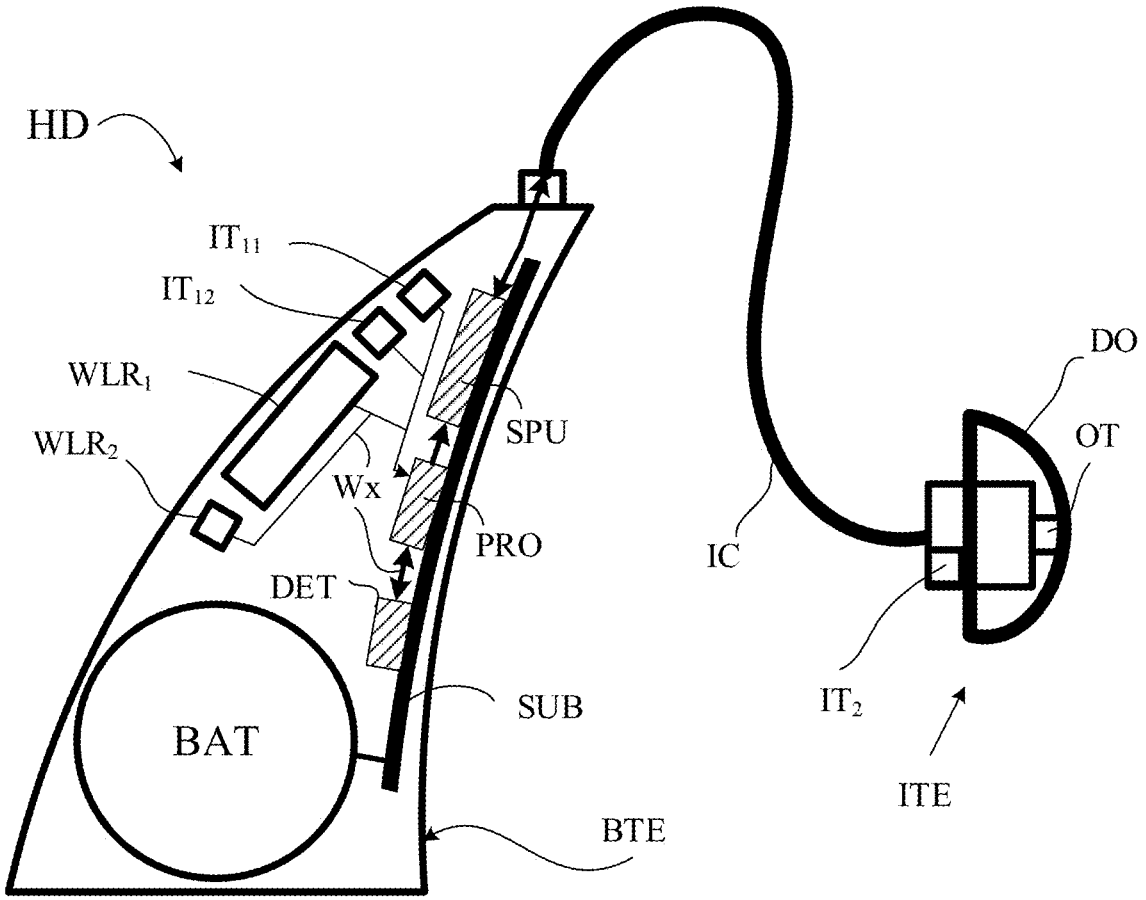
FIG. 4 shows an embodiment of a hearing device according to the present disclosure.

FIG. 4 shows an embodiment of a hearing device according to the present disclosure. FIG. 4 shows an embodiment of a hearing system comprising a hearing device (HD) comprising a BTE-part (BTE) adapted for being located behind pinna and a part (ITE) adapted for being located in an ear canal of the user. The ITE-part may, as shown in FIG. 4, comprise an output transducer (e.g. a loudspeaker/receiver) adapted for being located in an ear canal of the user and to provide an acoustic signal (providing, or contributing to, an acoustic signal at the ear drum). In the latter case, a so-called receiver-in-the-ear (RITE) type hearing aid is provided. The BTE-part (BTE) and the ITE-part (ITE) are connected (e.g. electrically connected) by a connecting element (IC), e.g. comprising a number of electric conductors. Electric conductors of the connecting element (IC) may e.g. have the purpose of transferring electrical signals from the BTE-part to the ITE-part, e.g. comprising audio signals to the output transducer, and/or for functioning as antenna for providing wireless interface. The BTE part (BTE) comprises an input unit comprising two input transducers (e.g. microphones) ($IT_{11}$, $T_{12}$) each for providing an electric input audio signal representative of an input sound signal from the environment. In the scenario of FIG. 4, the input sound signal $S_{BTE}$ includes a contribution from sound source S (and possibly additive noise from the environment). The hearing aid (HD) of FIG. 4 further comprises two wireless transceivers ($WLR_1$, $WLR_2$) for transmitting and/or receiving respective audio and/or information signals and/or control signals (possibly including localization data from external detectors, and/or one or more audio signals from a contra-lateral hearing device or an auxiliary device). The hearing aid (HD) further comprises a substrate (SUB) whereon a number of electronic components are mounted, functionally partitioned according to the application in question (analogue, digital, passive components, etc.), but including a configurable signal processor (SPU), e.g. comprising a processor for executing a number of processing algorithms, e.g. to compensate for a hearing loss of a wearer of the hearing device), a processor (PRO, cf. e.g. PRO1, PRO2 of FIG. 3) for extracting localization data according to the present disclosure, and a detector unit (DET) coupled to each other and to input and output transducers and wireless transceivers via electrical conductors Wx. Typically a front end IC for interfacing to the input and output transducers, etc. is further included on the substrate. The mentioned functional units (as well as other components) may be partitioned in circuits and components according to the application in question (e.g. with a view to size, power consumption, analogue vs. digital processing, etc.), e.g. integrated in one or more integrated circuits, or as a combination of one or more integrated circuits and one or more separate electronic components (e.g. inductor, capacitor, etc.). The configurable signal processor (SPU) provides a processed audio signal, which is intended to be presented to a user. In the embodiment of a hearing device in FIG. 4, the ITE part (ITE) comprises an input transducer (e.g. a microphone) ($IT_2$) for providing an electric input audio signal representative of an input sound signal from the environment (including from sound source S) at or in the ear canal. In another embodiment, the hearing aid may comprise only the BTE-microphones ($IT_{11}$, $IT_{12}$). In another embodiment, the hearing aid may comprise only the ITE-microphone (IT2). In yet another embodiment, the hearing aid may comprise an input unit located elsewhere than at the ear canal in combination with one or more input units located in the BTE-part and/or the ITE-part. The ITE-part may further comprise a guiding element, e.g. a dome (DO) or equivalent, for guiding and positioning the ITE-part in the ear canal of the user.

The hearing aid (HD) exemplified in FIG. 4 is a portable device and further comprises a battery, e.g. a rechargeable battery, (BAT) for energizing electronic components of the BTE- and possibly of the ITE-parts.

In an embodiment, the hearing device (HD) of FIG. 4 form part of a hearing system according to the present disclosure for localizing a target sound source in the environment of a user.

The hearing aid (HD) may e.g. comprise a directional microphone system (including a beamformer filtering unit) adapted to spatially filter out a target acoustic source among a multitude of acoustic sources in the local environment of the user wearing the hearing aid, and to suppress 'noise' from other sources in the environment. The beamformer filtering unit may receive as inputs the respective electric signals from input transducers $IT_{11}$, $IT_{12}$, $IT_2$ (and possibly further input transducers) (or any combination thereof) and generate a beamformed signal based thereon. In an embodiment, the directional system is adapted to detect (such as adaptively detect) from which direction a particular part of the microphone signal (e.g. a target part and/or a noise part) originates. In an embodiment, the beam former filtering unit is adapted to receive inputs from a user interface (e.g. a remote control or a smartphone) regarding the present target direction. A memory unit (MEM) may e.g. comprise predefined (or adaptively determined) complex, frequency dependent constants ($Wi_j$) defining predefined (or adaptively determined) or 'fixed' beam patterns (e.g. omni-directional, target cancelling, pointing in a number of specific directions relative to the user), together defining a beamformed signal $Y_{BF}$.

The hearing aid of FIG. 4 may constitute or form part of a hearing aid and/or a binaural hearing aid system according to the present disclosure. The processing of an audio signal in a forward path of the hearing aid (the forward path including the input transducer(s), the signal processor, and the output transducer) may e.g. be performed fully or partially in the time-frequency domain. Likewise, the processing of signals in an analysis or control path of the hearing aid may be fully or partially performed in the time-frequency domain.

Figure 5:
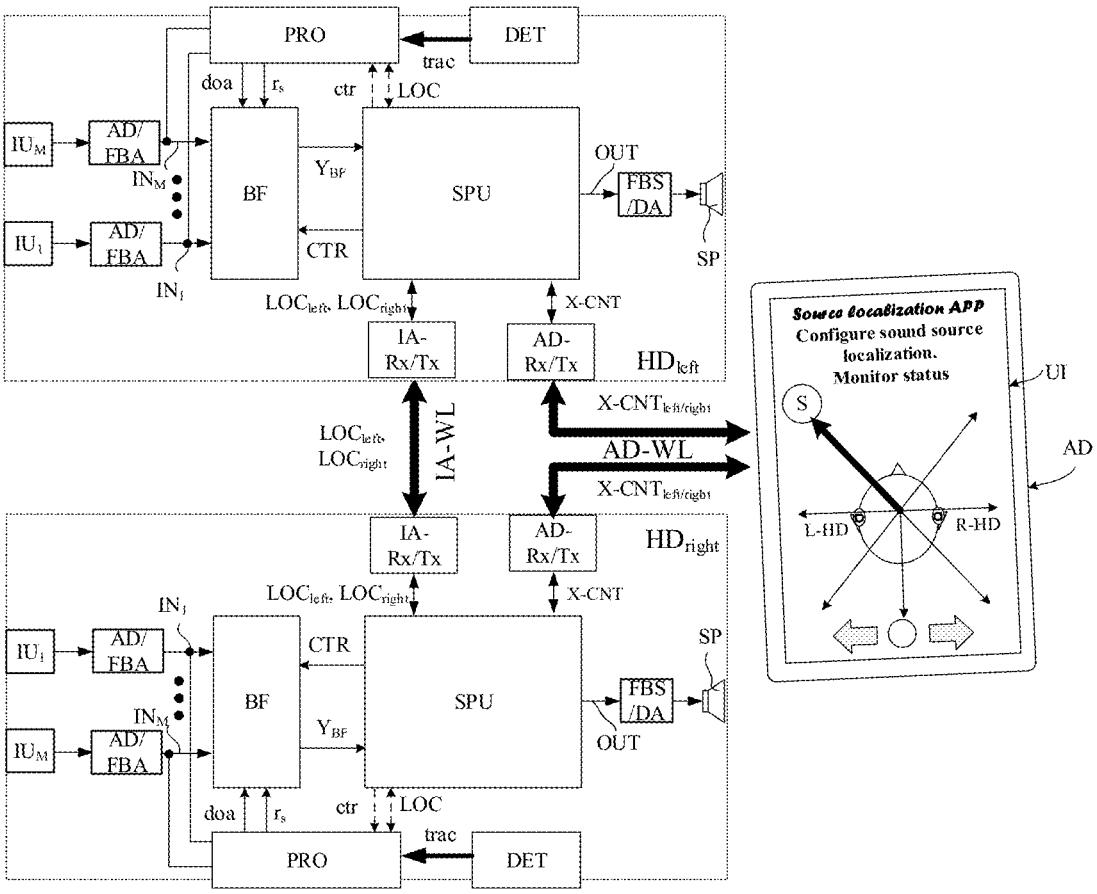
FIG. 5 shows a second embodiment of a hearing system according to the present disclosure in communication with an auxiliary device.

The hearing aid (HD) according to the present disclosure may comprise a user interface UI, e.g. as shown in FIG. 5 implemented in an auxiliary device (AD), e.g. a remote control, e.g. implemented as an APP in a smartphone or other portable (or stationary) electronic device.

FIG. 5 shows a second embodiment of a hearing system according to the present disclosure in communication with an auxiliary device. FIG. 5 shows an embodiment of a binaural hearing system comprising left and right hearing devices ($HD_{left}$, $HD_{right}$) and an auxiliary device (AD) in communication with each other according to the present disclosure. The left and right hearing devices are adapted for being located at or in left and right ears and/or for fully or partially being implanted in the head at left and right ears of a user. The left and right hearing devices and the auxiliary device (e.g. a separate processing or relaying device, e.g. a smartphone or the like) are configured to allow an exchange of data between them (cf. links IA-WL (localization data $LOC_{left}$, $LOC_{right}$, respectively) and AD-WL (control-information signals $X\text{-}CNT_{left/right}$) in FIG. 5), including exchanging localization data, audio data, control data, information, or the like. The binaural hearing system comprises a user interface (UI) fully or partially implemented in the auxiliary device (AD), e.g. as an APP, cf. Source localization APP screen of the auxiliary device (AD) in FIG. 5. The APP allows a display of a current localization of a sound source S relative to the user (wearing the hearing system), and allows to control functionality of the hearing system, e.g. an activation or deactivation of source localization according to the present disclosure.

The left and right hearing devices each comprise a forward path between M input units IU, i=1, . . . , M (each comprising e.g. an input transducer, such as a microphone or a microphone system and/or a direct electric input (e.g. a wireless receiver)) and an output unit (SP), e.g. an output transducer, here a loudspeaker. A beamformer or selector (BF) and a signal processor (SPU) is located in the forward path. In an embodiment, the signal processor is adapted to provide a frequency dependent gain according to a user's particular needs. In the embodiment of FIG. 5, the forward path comprises appropriate analogue to digital converters and analysis filter banks (AD/FBA) to provide input signals $IN_1$, . . . , $IN_M$ (and to allow signal processing to be conducted) in frequency sub-bands (in the (time-) frequency domain) In another embodiment, some or all signal processing of the forward path is conducted in the time domain. The weighting unit (beamformer or mixer or selector) (BFU) provides beamformed or mixed or selected signal $Y_{BF}$ based on one or more of the input signals $IN_1$, . . . , $IN_M$. The function of the weighting unit (BF) is controlled via the signal processor (SPU), cf. signal CTR, e.g. influenced by the user interface (signal X-CNT) and/or the localization signals doa and $r_s$ representing direction of arrival and distance, respectively, to a currently active sound source in the environment (as determined according to the present disclosure). The forward path further comprises a synthesis filter bank and appropriate digital to analogue converter (FBS/DA) to prepare the processed frequency sub-band signals OUT from the signal processor (SPU) as an analogue time domain signal for presentation to a user via the output transducer (loudspeaker) (SP). The respective configurable signal processor s(SPU) are in communication with the respective processors (PRO) for determining localization data (doa and $r_s$) via signals ctr and LOC. The control signal ctr from unit SPU to unit PRO may e.g. allow the signal processor (SPU) to control a mode of operation of the system, (e.g. via the user interface), e.g. to activate or deactivate source localization (or otherwise influence it). Data signals LOC may be exchanged between the two processing units, e.g. to allow localization data from a contra-lateral hearing device to influence the resulting localization data applied to the beamformer filtering unit (BF), e.g. exchanged via the link IA-WL ($LOC_{left}$, $LOC_{right}$). The interaural wireless ling IA-WL for the transfer of audio and/or control signals between the left and right hearing devices may e.g. be based on near-field communication, e.g. magnetic induction technologies (such as NFC or proprietary schemes).

Figure 6:
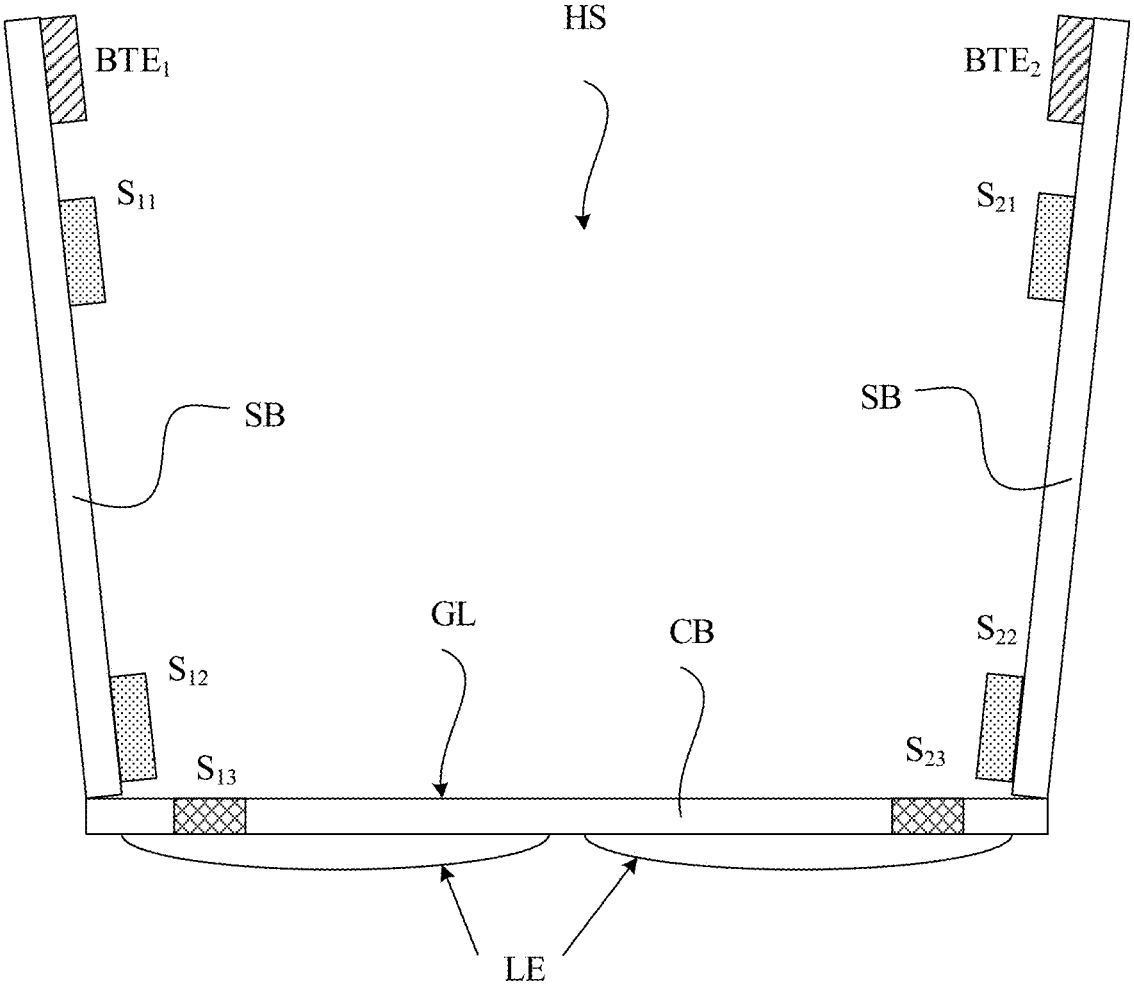
FIG. 6 shows a third embodiment of a hearing system according to the present disclosure.

FIG. 6 shows a third embodiment of a hearing system (HS) according to the present disclosure. FIG. 6 shows an embodiment of a hearing system according to the present disclosure comprising left and right hearing devices and a number of sensors mounted on a spectacle frame. The hearing system (HS) comprises a number of sensors $S_{1i}$, $S_{2i}$ (i=1, . . . , $N_S$) associated with (e.g. forming part of or connected to) left and right hearing devices ($HD_1$, $HD_2$), respectively. The first, second and third sensors $S_{11}$, $S_{12}$, $S_{13}$ and $S_{21}$, $S_{22}$, $S_{23}$ are mounted on a spectacle frame of the glasses (GL). In the embodiment of FIG. 3, sensors $S_{11}$, $S_{12}$ and $S_{21}$, $S_{22}$ are mounted on the respective sidebars ($SB_1$ and $SB_2$), whereas sensors $S_{13}$ and $S_{23}$ are mounted on the cross bar (CB) having hinged connections to the right and left side bars ($SB_1$ and $SB_2$). Glasses or lenses (LE) of the spectacles are mounted on the cross bar (CB). The left and right hearing devices ($HD_1$, $HD_2$) comprises respective BTE-parts ($BTE_1$, $BTE_2$), and may e.g. further comprise respective ITE-parts ($ITE_1$, $ITE_2$). The ITE-parts may e.g. comprise electrodes for picking up body signals from the user, e.g. forming part of sensors $S_{1i}$, $S_{2i}$ (i=1, . . . , $N_S$) for monitoring physiological functions of the user, e.g. brain activity or eye movement activity or temperature. The sensors (detectors, cf. detector unit DET in FIG. 3) mounted on the spectacle frame may e.g. comprise one or more of an accelerometer, a gyroscope, a magnetometer, a radar sensor, an eye camera (e.g. for monitoring pupillometry), etc., or other sensors for localizing or contributing to localization of a sound source of interest to the user wearing the hearing system.

Figure 7:
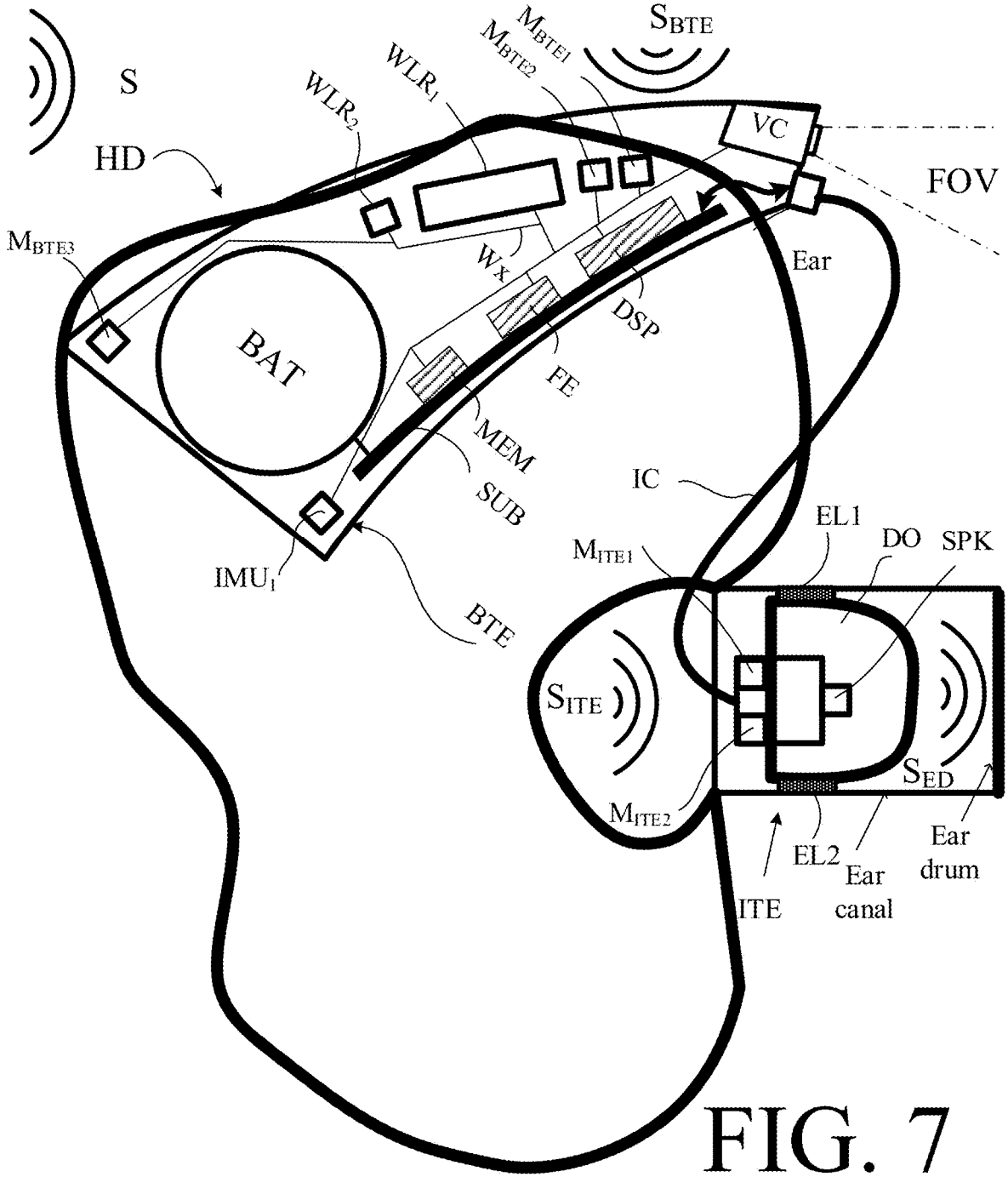
FIG. 7 shows a fourth embodiment of a hearing system according to the present disclosure.

FIG. 7 shows an embodiment of a hearing system according to the present disclosure. The hearing system comprises a hearing device (HD), e.g. a hearing aid, here illustrated as a particular style (sometimes termed receiver-in-the ear, or RITE, style) comprising a BTE-part (BTE) adapted for being located at or behind an ear of a user, and an ITE-part (ITE) adapted for being located in or at an ear canal of the user's ear and comprising a receiver (loudspeaker, SPK). The BTE-part and the ITE-part are connected (e.g. electrically connected) by a connecting element (IC) and internal wiring in the ITE- and BTE-parts (cf. e.g. wiring Wx in the BTE-part). The connecting element may alternatively be fully or partially constituted by a wireless link between the BTE- and ITE-parts.

In the embodiment of a hearing device in FIG. 7, the BTE part comprises three input units comprising respective input transducers (e.g. microphones) ($M_{BTE1}$, $M_{BTE2}$, $M_{BTE3}$), each for providing an electric input audio signal representative of an input sound signal ($S_{BTE}$) (originating from a sound field S around the hearing device). The input unit further comprises two wireless receivers ($WLR_1$, $WLR_2$) (or transceivers) for providing respective directly received auxiliary audio and/or control input signals (and/or allowing transmission of audio and/or control signals to other devices, e.g. a remote control or processing device). The input unit further comprises a video camera (VC) located in the housing of the BTE-part, e.g. so that its field of view (FOV) is directed in a look direction of the user wearing the hearing device (here next to the electric interface to the connecting element (IC)). The video camera (VC) may e.g. be coupled to a processor and arranged to constitute a scene camera for SLAM. The hearing device (HD) comprises a substrate (SUB) whereon a number of electronic components are mounted, including a memory (MEM) e.g. storing different hearing aid programs (e.g. parameter settings defining such programs, or parameters of algorithms (e.g. for implementing SLAM), e.g. optimized parameters of a neural network) and/or hearing aid configurations, e.g. input source combinations ($M_{BTE1}$, $M_{BTE2}$, $M_{BTE3}$, $M_{ITE1}$, $M_{ITE2}$, $WLR_1$, $WLR_2$, VC), e.g. optimized for a number of different listening situations. The substrate further comprises a configurable signal processor (DSP, e.g. a digital signal processor, e.g. including a processor (e.g. PRO in FIG. 2A) for applying a frequency and level dependent gain, e.g. providing beamforming, noise reduction (including improvements using the camera), filter bank functionality, and other digital functionality of a hearing device according to the present disclosure). The configurable signal processor (DSP) is adapted to access the memory (MEM) and for selecting and processing one or more of the electric input audio signals and/or one or more of the directly received auxiliary audio input signals, and/or the camera signal based on a currently selected (activated) hearing aid program/parameter setting (e.g. either automatically selected, e.g. based on one or more sensors, or selected based on inputs from a user interface). The mentioned functional units (as well as other components) may be partitioned in circuits and components according to the application in question (e.g. with a view to size, power consumption, analogue vs. digital processing, etc.), e.g. integrated in one or more integrated circuits, or as a combination of one or more integrated circuits and one or more separate electronic components (e.g. inductor, capacitor, etc.). The configurable signal processor (DSP) provides a processed audio signal, which is intended to be presented to a user. The substrate further comprises a front-end IC (FE) for interfacing the configurable signal processor (DSP) to the input and output transducers, etc., and typically comprising interfaces between analogue and digital signals. The input and output transducers may be individual separate components, or integrated (e.g. MEMS-based) with other electronic circuitry.

The hearing system (here, the hearing device HD) further comprises a detector unit comprising one or more inertial measurement units (IMU), e.g. a 3D gyroscope, a 3D accelerometer and/or a 3D magnetometer, here denoted IMU1 and located in the BTE-part (BTE). Inertial measurement units (IMUs), e.g. accelerometers, gyroscopes, and magnetometers, and combinations thereof, are available in a multitude of forms (e.g. multi-axis, such as 3D-versions), e.g. constituted by or forming part of an integrated circuit, and thus suitable for integration, even in miniature devices, such as hearing devices, e.g. hearing aids. The sensor IMU1 may thus be located on the substrate (SUB) together with other electronic components (e.g. MEM, FE, DSP). One or more movement sensors (IMU) may alternatively or additionally be located in or on the ITE part (ITE) or in or on the connecting element (IC).

The hearing device (HD) further comprises an output unit (e.g. an output transducer) providing stimuli perceivable by the user as sound based on a processed audio signal from the processor or a signal derived therefrom. In the embodiment of a hearing device in FIG. 7, the ITE part comprises the output unit in the form of a loudspeaker (also termed a 'receiver') (SPK) for converting an electric signal to an acoustic (air borne) signal, which (when the hearing device is mounted at an ear of the user) is directed towards the ear drum (Ear drum), where sound signal ($S_{ED}$) is provided. The ITE-part further comprises a guiding element, e.g. a dome, (DO) for guiding and positioning the ITE-part in the ear canal (Ear canal) of the user. The ITE part (e.g. a housing or a soft or rigid or semi-rigid dome-like structure) comprises a number of electrodes or electric potential sensors (EPS) (EL1, EL2) for picking up signals (e.g. potentials or currents) from the body of the user, when mounted in the ear canal. The signals picked up by the electrodes or EPS may e.g. be used for estimating an eye gaze angle of the user (using EOG). The ITE-part further comprises two further input transducers, e.g. a microphone ($M_{ITE1}$, $M_{ITE2}$) for providing respective electric input audio signal representative of a sound field ($S_{ITE}$) at the ear canal.

An auxiliary electric signal derived from visual information from video camera VC may be used in a mode of operation where it is combined with an electric sound signal from one of more of the input transducers (e.g. the microphones) to localize sound sources relative to the user. In another mode of operation, the a beamformed signal is provided by appropriately combining electric input signals from the input transducers ($M_{BTE1}$, $M_{BTE2}$, $M_{BTE3}$, $M_{ITE1}$, $M_{ITE2}$), e.g. by applying appropriate complex weights to the respective electric input signals (beamformer). In a mode of operation, the auxiliary electric signal is used as input to a processing algorithm (e.g. a single channel noise reduction algorithm) to enhance a signal of the forward path, e.g. a beamformed (spatially filtered) signal.

The electric input signals (from input transducers $M_{BTE1}$, $M_{BTE2}$, $M_{BTE3}$, $M_{ITE1}$, $M_{ITE2}$) may be processed in the time domain or in the (time-) frequency domain (or partly in the time domain and partly in the frequency domain as considered advantageous for the application in question).

The hearing device (HD) exemplified in FIG. 7 is a portable device and further comprises a battery (BAT), e.g. a rechargeable battery, e.g. based on Li-Ion battery technology, e.g. for energizing electronic components of the BTE- and possibly ITE-parts. In an embodiment, the hearing device, e.g. a hearing aid, is adapted to provide a frequency dependent gain and/or a level dependent compression and/or a transposition (with or without frequency compression) of one or more frequency ranges to one or more other frequency ranges, e.g. to compensate for a hearing impairment of a user.

The hearing device in FIG. 7 may thus implement a hearing system comprising a combination of EOG (based on EOG sensors (EL1, EL2), e.g. electrodes) for eye-tracking and a scene camera (VC) for SLAM combined with movement sensors (IMU1) for motion tracking/head rotation.

Figure 8:
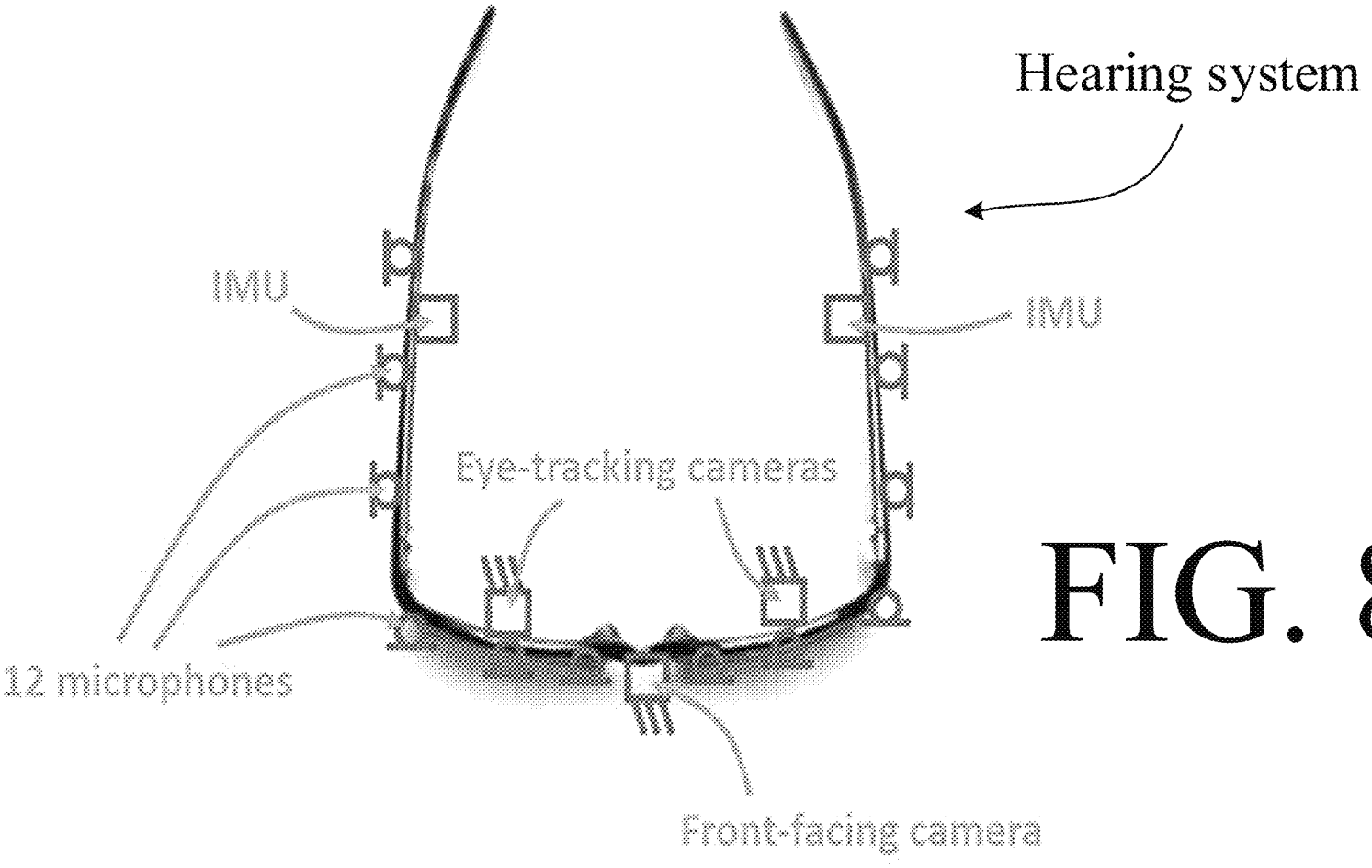
FIG. 8 shows a fifth embodiment of a hearing system according to the present disclosure.

FIG. 8 shows a further embodiment of a hearing system according to the present disclosure. The hearing system comprises a spectacle frame comprising a number of input transducers here 12 microphones, 3 on each of the left and right side bars, and 6 on the cross-bar. Thereby an acoustic image of (most) of the sound scene of interest to the user can be monitored. Further, the hearing system comprises a number of movement sensors (IMU), here two, one on each of the left and right side bars for picking up movement of the user, incl. rotation of the user's head. The hearing system further comprises a number of cameras, here 3. All three cameras are located on the cross-bar. Two of the cameras (denoted Eye-tracking cameras in FIG. 8) are located and oriented towards the face of the user and to allow a monitoring of the user's eyes, e.g. to provide an estimate of a current eye gaze of the user. The third camera (denoted Front-facing camera in FIG. 8) is located in the middle of the cross-bar and oriented to allow it to monitor the environment in front of the user, e.g. in a look direction of the user.

The hearing system in FIG. 8 may thus implement a hearing system comprising a carrier (here in the form of a spectacle frame) configured to host at least some of the input transducers of the system (here 12 microphones), a number of cameras (a scene camera, e.g. for Simultaneous Localization and Mapping (SLAM) and two eye-tracking cameras for eye gaze). The hearing system may e.g. further comprise one or two hearing devices adapted to be located at the ears of a user (e.g. mounted on or connected to the carrier (spectacle frame) and operationally coupled to the (12) microphones and the (3) cameras. The hearing system may thus be configured to localize sound sources in the environment of the user and to use this localization to improve the processing of the hearing device(s), e.g. to compensate for a hearing impairment of a user and/or to assist a user in a difficult sound environment.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening element may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

[Jazwinski; 1970] Andrew H. Jazwinski, Stochastic Processes and Filtering Theory, vol. 64 of Mathematics in Science and Engineering, Academic Press, Inc, 1970.

[Knapp & Carter; 1976] C. Knapp and G. Carter, "The generalized correlation method for estimation of time delay," IEEE Transactions on Acoustics, Speech, and Signal Processing, vol. 24, no. 4, pp. 320-327, August 1976.

[Levenberg; 1944] Kenneth Levenberg, "A method for the solution of certain non-linear problems in least squares," Quarterly Journal of Applied Mathematics, vol. II, no. 2, pp. 164-168, 1944.

[Marquardt; 1963] Donald W. Marquardt, "An algorithm for least-squares estimation of nonlinear parameters," SIAM Journal on Applied Mathematics, vol. 11, no. 2, pp. 431-441, 1963.

EP2701145A1 (Oticon, Retune) Feb. 26, 2014.

EP3267697A1 (Oticon) Jan. 1, 2018.

The invention claimed is:

1. A hearing system adapted to be worn by a user and configured to capture sound in an environment of the user, the hearing system comprising a sensor array of M input transducers, where M≥2, each for providing an electric input signal representing said sound in said environment, said input transducers $p_i$, i=1, . . . , M, of said array having a geometrical configuration relative to each other, when worn by the user, and a detector unit for detecting movements over time of the hearing system when worn by the user, and providing location data of said sensor array at different points in time t, t=1, . . . , N;

a first processor for receiving said electric input signals and for extracting sensor array configuration specific data $\tau_{ij}$ of said sensor array indicative of differences between a time of arrival of sound from said localized sound source S at said respective input transducers, at said different points in time t, t=1, . . . , N;

a second processor configured to estimate data indicative of a location of said localized sound source S relative to the user based on corresponding values of said location data and said sensor array configuration specific data at said different points in time t, t=1, . . . , N.

2. A hearing system according to claim 1 wherein the detector unit is configured to detect rotational and/or translational movements of the hearing system.

3. A hearing system according to claim 1 wherein said data indicative of a location of said localized sound source S relative to the user at said different points in time t, t=1, . . . , N constitutes or comprises a direction of arrival of sound from said sound source S.

4. A hearing system according to claim 1 wherein said data indicative of a location of said localized sound source S relative to the user at said different points in time t, t=1, . . . , N comprises coordinates of said sound source relative said user, or direction of arrival of sound from and distance to said sound source relative said user.

5. A hearing system according to claim 1 wherein said detector unit comprises a number of IMU-sensors including at least one of an accelerometer, a gyroscope and a magnetometer.

6. A hearing system according to claim 5 wherein at least one of said IMU-sensors is located in a separate device.

7. A hearing system according to claim 1 wherein said second processor is configured to estimate data indicative of a location of said localized sound source S relative to the user based on the following expression for stacked residual vectors $r(S^e)$ originating from said time instances t=1, . . . , N $$r(S^e)=y_t^{ij}-h_{ij}(S^e,R_t,T_t^e)$$

where $S^e$ represent the position of said sound source in an inertial frame of reference, $R_t$ and $T_t^e$ are matrices describing a rotation and a translation, respectively, of the sensor array with respect to the inertial frame at time t, and $y_t^{ij}=\tau_{ij}+e_t$ represent said sensor array configuration specific data, where $\tau_{ij}$ represent said differences between a time of arrival of sound from said localized sound source Sat said respective input transducers i, j, and $e_t$ represents measurement noise, where (i,j)=1, . . . , M, j>i, wherein $h_{ij}$ is a model of the time differences $\tau_{ij}$ between each microphone pair $P_i$ and $p_j$.

8. A hearing system according to claim 7 wherein the second processor is configured to solve the problem represented by the stacked residual vectors $r(S^e)$ in a maximum likelihood framework.

9. A hearing system according to claim 7 wherein the second processor is configured to solve the problem represented by the stacked residual vectors $r(S^e)$ using an Extended Kalman filter (EKF) algorithm.

10. A hearing system according to claim 1 comprising first and second hearing devices, adapted to be located at or in left and right ears of the user, or to be fully or partially implanted in the head at the left and right ears of the user, each of the first and second hearing devices comprising at least one input transducer for providing an electric input signal representing sound in said environment, at least one output transducer for providing stimuli perceivable to the user as representative of said sound in the environment, wherein said at least one input transducer of said first and second hearing devices constitutes or form part of said sensor array.

11. A hearing system according to claim 10 wherein each of the first and second hearing device comprises circuitry for wirelessly exchanging said electric input signals, or parts thereof, with the other hearing device, and/or with an auxiliary device.

12. A hearing system according to claim 10 wherein the first and second hearing devices are constituted by or comprises respective first and second hearing aids.

13. A hearing system according to claim 1 comprising a hearing aid, a headset, an earphone, an ear protection device or a combination thereof.

14. A hearing system according to claim 1 comprising an auxiliary device comprising said second processor.

15. A hearing system according to claim 1 comprising a carrier configured to carry at least some of the M input transducers of the sensor array, wherein the carrier has a dimension larger than 0.10 m.

16. A hearing system according to claim 15 wherein the carrier may be configured to carry at least some of the sensors of the detector unit.

17. A hearing system according to claim 1 the number M input transducers is larger than or equal to 8.

18. A hearing system according to claim 1 comprising one or more cameras.

19. A hearing system according to claim 1 comprising a number of EOG sensors or an eye tracking camera for eye-tracking, and a scene camera for Simultaneous Localization and Mapping (SLAM) combined with a number of Inertial Measurements Units (IMUs) for motion tracking/head rotation.

20. A method of operating a hearing system adapted to be worn by a user and configured to capture sound in an environment of the user, when said hearing system is operationally mounted on the user, the hearing system comprising sensor array of M input transducers, where M≥2, each for providing an electric input signal representing said sound in said environment, said input transducers $p_i$, i=1, . . . , M, of said array having a geometrical configuration relative to each other, when worn by the user, the method comprising detecting movements over time of the hearing system when worn by the user, and providing location data of said sensor array at different points in time t, t=1, . . . , N;

when said sound comprises sound from a localized sound source S extracting sensor array configuration specific data $\tau_{ij}$ of said sensor array indicative of differences between a time of arrival of sound from said localized sound source S at said respective input transducers, at said different points in time t, t=1, . . . , from said electric input signals; and estimating data indicative of a location of said localized sound source S relative to the user based on corresponding values of said location data and said sensor array configuration specific data at said different points in time t, t=1, . . . , N.

* * * * *